US012544815B2

(12) United States Patent
Norikura et al.

(10) Patent No.: US 12,544,815 B2
(45) Date of Patent: Feb. 10, 2026

(54) MULTISTAGE ROLLING MILL AND METHOD OF CHANGING DIVIDED BACKING BEARING ASSEMBLED SHAFTS IN MULTISTAGE ROLLING MILL

(71) Applicant: SENDZIMIR JAPAN, LTD., Tokyo (JP)

(72) Inventors: Takashi Norikura, Tokyo (JP); Tadashi Tamagawa, Tokyo (JP)

(73) Assignee: SENDZIMIR JAPAN, LTD., Tokyo (JP)

( * ) Notice: Subject to any disclaimer, the term of this patent is extended or adjusted under 35 U.S.C. 154(b) by 628 days.

(21) Appl. No.: 17/600,132

(22) PCT Filed: Apr. 1, 2020

(86) PCT No.: PCT/JP2020/015024
§ 371 (c)(1),
(2) Date: Sep. 30, 2021

(87) PCT Pub. No.: WO2020/204071
PCT Pub. Date: Oct. 8, 2020

(65) Prior Publication Data

US 2022/0203416 A1 Jun. 30, 2022

(30) Foreign Application Priority Data

Apr. 4, 2019 (JP) ..... 2019-072181

(51) Int. Cl.
*B21B 13/14* (2006.01)
*B21B 31/10* (2006.01)

(52) U.S. Cl.
CPC ..... *B21B 13/147* (2013.01); *B21B 31/103* (2013.01)

(58) Field of Classification Search
CPC ..... B21B 13/147; B21B 13/14; B21B 31/103; B21B 31/10; B21B 31/08; B21B 2203/32
(Continued)

(56) References Cited

U.S. PATENT DOCUMENTS 2,776,586 A * 1/1957 Sendzimir ..... B21B 31/18 72/242.4
4,435,970 A * 3/1984 Sekiya ..... B21B 31/103 72/239
(Continued)

FOREIGN PATENT DOCUMENTS

CN 201127950 Y 10/2008
JP 49-8442 A 1/1974
(Continued)

OTHER PUBLICATIONS

Machine translation of JP-H05317932-A (Year: 1993).*
(Continued)

*Primary Examiner* — Christopher L Templeton
*Assistant Examiner* — Teresa A Guthrie
(74) *Attorney, Agent, or Firm* — MATTINGLY & MALUR, PC

(57) ABSTRACT

Within a housing, divided backing bearing assembled shafts are each moved on any one of a housing bore upper surface 8*a* constituting the housing, spray frame upper surfaces 9, and rails 13, 19, and 20 of a changing carriage 12 by sliding apparatuses, and outside the housing, the divided backing bearing assembled shafts are extracted from within the housing or inserted into the housing by being moved on the rails 13, 19, and 20 of the changing carriage 12 by sliding apparatuses. There are thus provided a rolling mill that makes changing of divided backing bearing assembled shafts in the rolling mill, and a method of changing the divided backing bearing assembled shafts in the rolling mill.

9 Claims, 19 Drawing Sheets

(58) Field of Classification Search
USPC ..... 72/241.2
See application file for complete search history.

(56) References Cited

U.S. PATENT DOCUMENTS

| | | | | |
|---|---|---|---|---|
| 5,142,896 | A * | 9/1992 | Berger | B21B 31/32 72/248 |
| 6,260,397 | B1 * | 7/2001 | Zheng | B21B 13/147 72/237 |
| 6,763,565 | B2 * | 7/2004 | Mukaigawa | B21B 31/103 29/895 |

FOREIGN PATENT DOCUMENTS

| | | | |
|---|---|---|---|
| JP | 52-8965 | A | 1/1977 |
| JP | 58-116915 | A | 7/1983 |
| JP | 05-023719 | A | 2/1993 |
| JP | H05317932 | A * | 12/1993 |
| JP | 60-61775 | B2 | 1/2017 |
| KR | 10-1511957 | B1 | 4/2015 |

OTHER PUBLICATIONS

Chinese Office Action received in corresponding Chinese Application No. 202080025758.4 dated Apr. 5, 2023.
Extended European Search Report received in corresponding European Application No. 20783300.5 dated Dec. 9, 2022.
"Recent Progresses in Cold Strip Equipment and Manufacturing Technology in Our Country," The Iron and Steel Institute of Japan, Aug. 1977, pp. 68-69.
International Search Report of PCT/JP2020/015024 dated Jun. 23, 2020.

* cited by examiner

PRIOR ART

PRIOR ART

PRIOR ART

PRIOR ART

MULTISTAGE ROLLING MILL AND METHOD OF CHANGING DIVIDED BACKING BEARING ASSEMBLED SHAFTS IN MULTISTAGE ROLLING MILL

TECHNICAL FIELD

The present invention relates to a multistage rolling mill and a method of changing divided backing bearing assembled shafts in the multistage rolling mill.

BACKGROUND ART

As an example of a method of changing divided backing bearing assembled shafts in a cluster type rolling mill, Non-Patent Document 1 describes changing using a porter bar provided with a counterweight hung by an overhead travelling crane.

PRIOR ART DOCUMENT

Patent Document

Non-Patent Document 1: (written by) The Iron and Steel Institute of Japan, "Recent Progresses in Cold Strip Equipment and Manufacturing Technology in Our Country," The Iron and Steel Institute of Japan, August 1977, P. 68-69

SUMMARY OF THE INVENTION

Problem to be Solved by the Invention

As shown in FIG. 1 and FIG. 2, a conventional cluster type 20-high rolling mill rolls a strip 1 as a material to be rolled by a pair of upper and lower work rolls 2.

The pair of upper and lower work rolls 2 is respectively in contact with and supported by two pairs of upper and lower first intermediate rolls 3. In addition, the two pairs of upper and lower first intermediate rolls 3 are respectively in contact with and supported by three pairs of upper and lower second intermediate rolls 4.

Further, the three pairs of upper and lower second intermediate rolls 4 are in contact with and supported by four pairs of upper and lower divided backing bearing assembled shafts each including a divided backing bearing 105, a shaft 106, and a saddle 107.

Then, the four pairs of upper and lower divided backing bearing assembled shafts are supported by a mono-block housing 108 via the saddles 107, and are fixed to the mono-block housing 108 via a clamp operation of saddle clamps 123.

In the multistage rolling mill such as such a conventional cluster type 20-high rolling mill, a 12-high rolling mill, or the like, the work rolls, the intermediate rolls, and the divided backing bearing assembled shafts need to be changed periodically.

Here, in the conventional cluster type 20-high rolling mill as shown in FIG. 3 and FIG. 4, as described in the above-mentioned Non-Patent Document 1, upper divided backing bearing assembled shafts A, B, C, and D on an upper side are changed by extracting the upper divided backing bearing assembled shafts A, B, C, and D from the rolling mill and inserting upper divided backing bearing assembled shafts A, B, C, and D into the rolling mill by using a porter bar 43 provided with a counterweight hung by an overhead travelling crane.

In addition, as shown in FIG. 5 and FIG. 6, lower divided backing bearing assembled shafts E, F, G, and H on a lower side are also changed by extracting the lower divided backing bearing assembled shafts E, F, G, and H and inserting lower divided backing bearing assembled shafts E, F, G, and H by using the porter bar 43 provided with the counterweight hung by the overhead travelling crane.

However, since the porter bar 43 provided with the counterweight hung by the overhead travelling crane is used, a skill is required to perform operation so as not to cause sway. There is thus a problem in workability.

In addition, there is a problem in that the overhead travelling crane cannot be used for other work in the meantime, which is a bottleneck in various kinds of processes before resumption of work. Thus, a device and a method for solving these problems have been awaited.

The present invention has been made in view of the above-described problems. It is an object of the present invention to provide a multistage rolling mill that makes changing of divided backing bearing assembled shafts easier than conventional, and a method of changing the divided backing bearing assembled shafts in the multistage rolling mill.

Means for Solving the Problem

The present invention includes a plurality of means for solving the above-described problems. To cite an example of the means, there is provided a cluster type multistage rolling mill including: a pair of work rolls rolling a metal strip; an intermediate roll group supporting the work rolls; a plurality of divided backing bearing assembled shafts supporting the intermediate roll group, the plurality of divided backing bearing assembled shafts each including a divided backing bearing, a shaft, and a saddle; a housing supporting the saddles; sliding apparatuses arranged on at least a drive side of the divided backing bearing assembled shafts; and a changing carriage disposed on an work side of the housing, the changing carriage having rails capable of being loaded with the divided backing bearing assembled shafts; within the housing, the divided backing bearing assembled shafts each being moved on one of a housing bore upper surface constituting the housing, spray frame upper surfaces, and the rails of the changing carriage by the sliding apparatuses, and outside the housing, the divided backing bearing assembled shafts being extracted from within the housing or inserted into the housing by being moved on the rails of the changing carriage by the sliding apparatuses.

Advantages of the Invention

According to the present invention, the changing of the divided backing bearing assembled shafts in the multistage rolling mill can be performed more easily than conventional. Problems, configurations, and effects other than those described above will be made apparent by the following description of embodiments.

MODES FOR CARRYING OUT THE INVENTION

Embodiments of a rolling mill according to the present invention and a method of changing divided backing bearing assembled shafts in the rolling mill will hereinafter be described with reference to the drawings.

First Embodiment

A first embodiment of a rolling mill according to the present invention and a method of changing divided backing bearing assembled shafts in the rolling mill will be described with reference to FIGS. 7 to 16.

Figure 1:
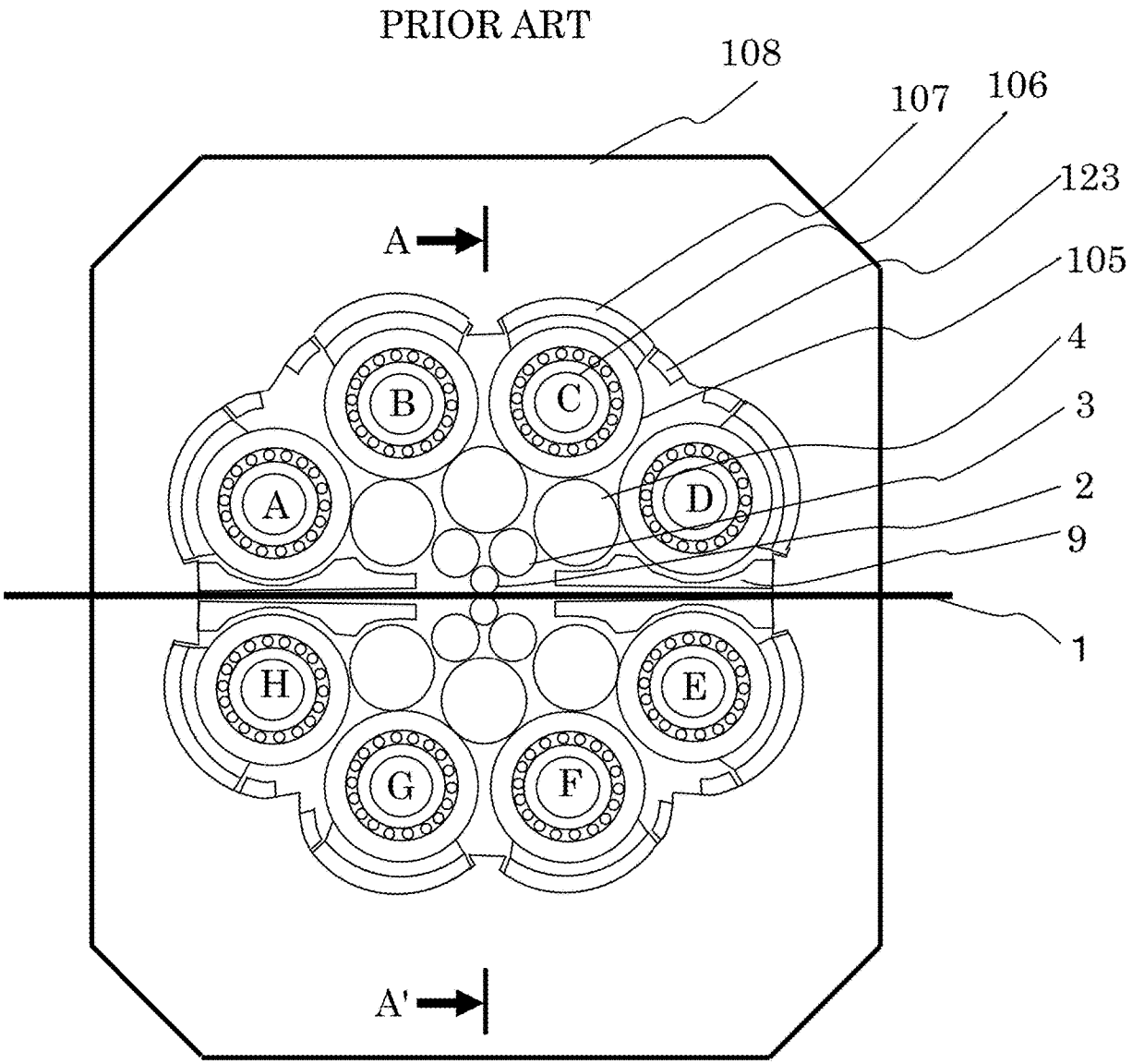
FIG. 1 is a front view of a conventional 20-high rolling mill.
Figure 2:
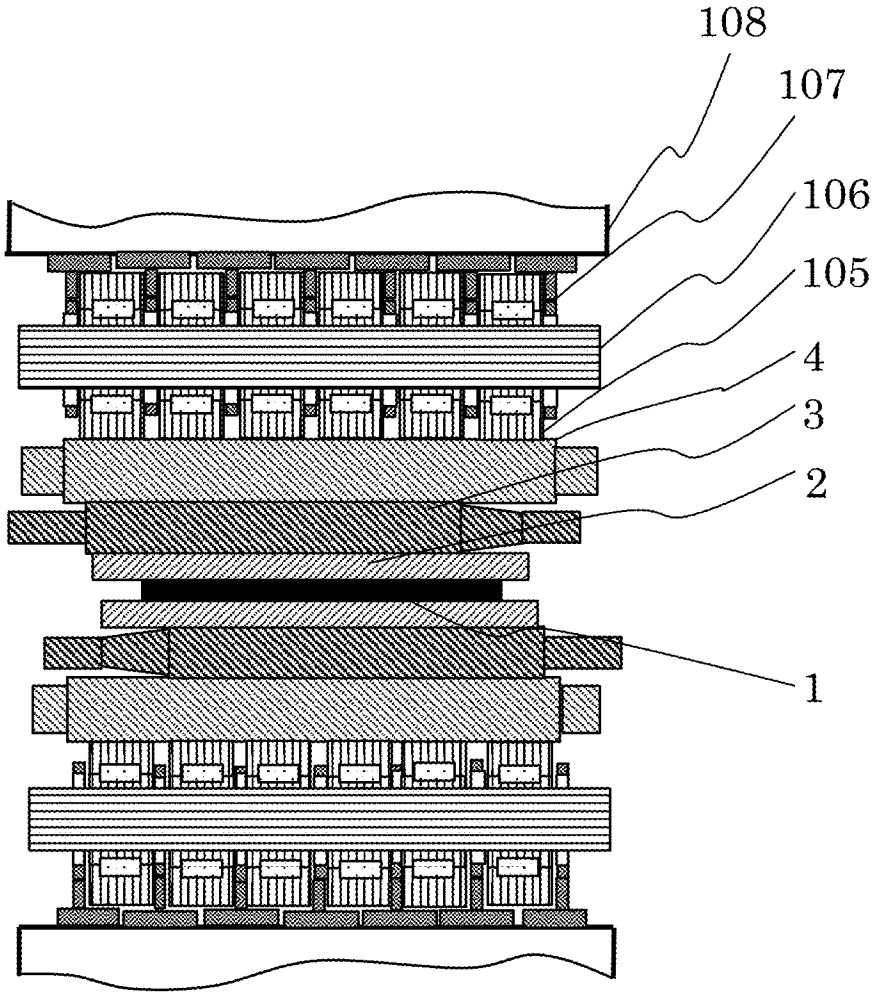
FIG. 2 is a sectional view taken in the direction of arrows A-A' in FIG. 1.
Figure 3:
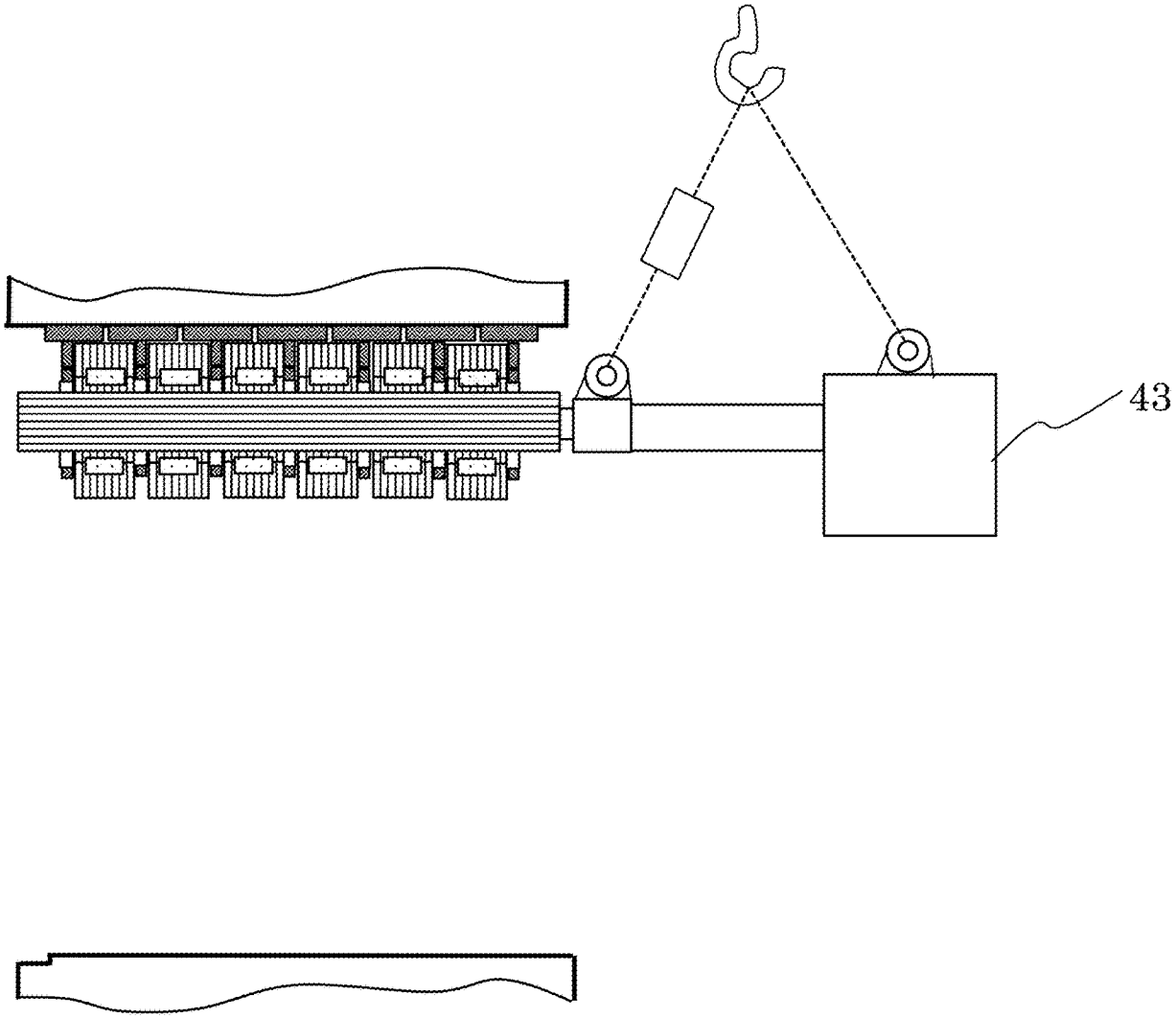
FIG. 3 is a diagram of assistance in explaining a state at a time of extracting upper divided bearing assembled shafts by a conventional porter bar.
Figure 4:
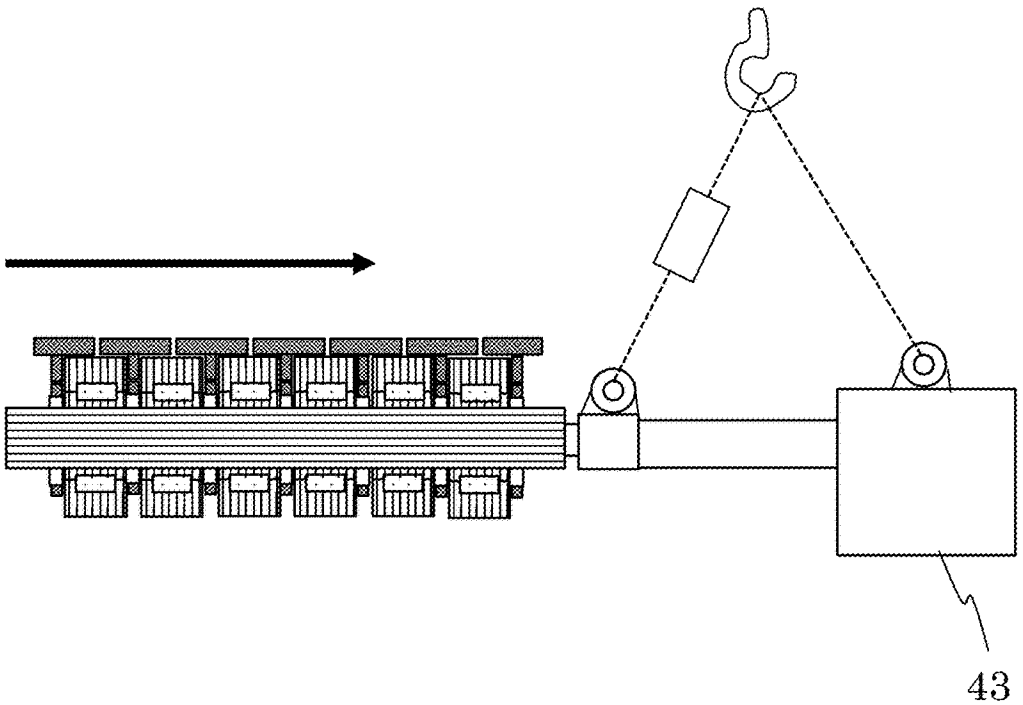
FIG. 4 is a diagram of assistance in explaining a state after the upper divided bearing assembled shafts are extracted by the conventional porter bar.
Figure 4:
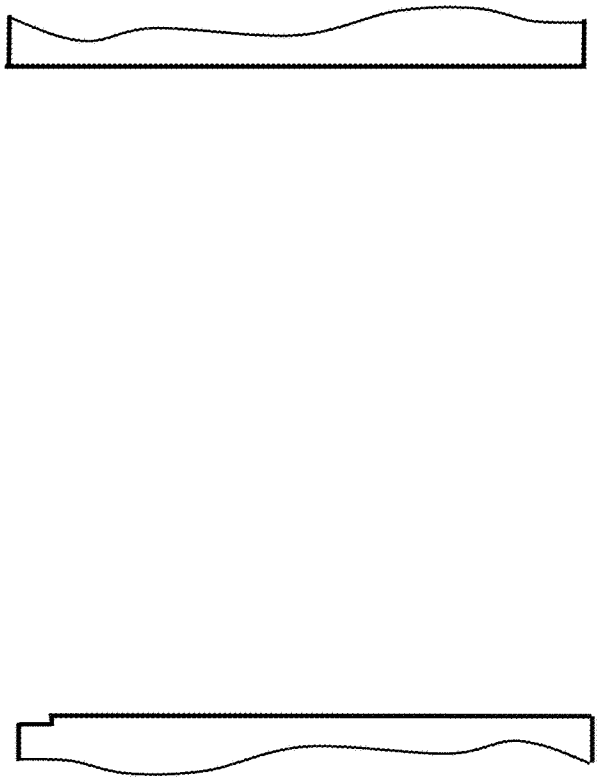
Figure 5:
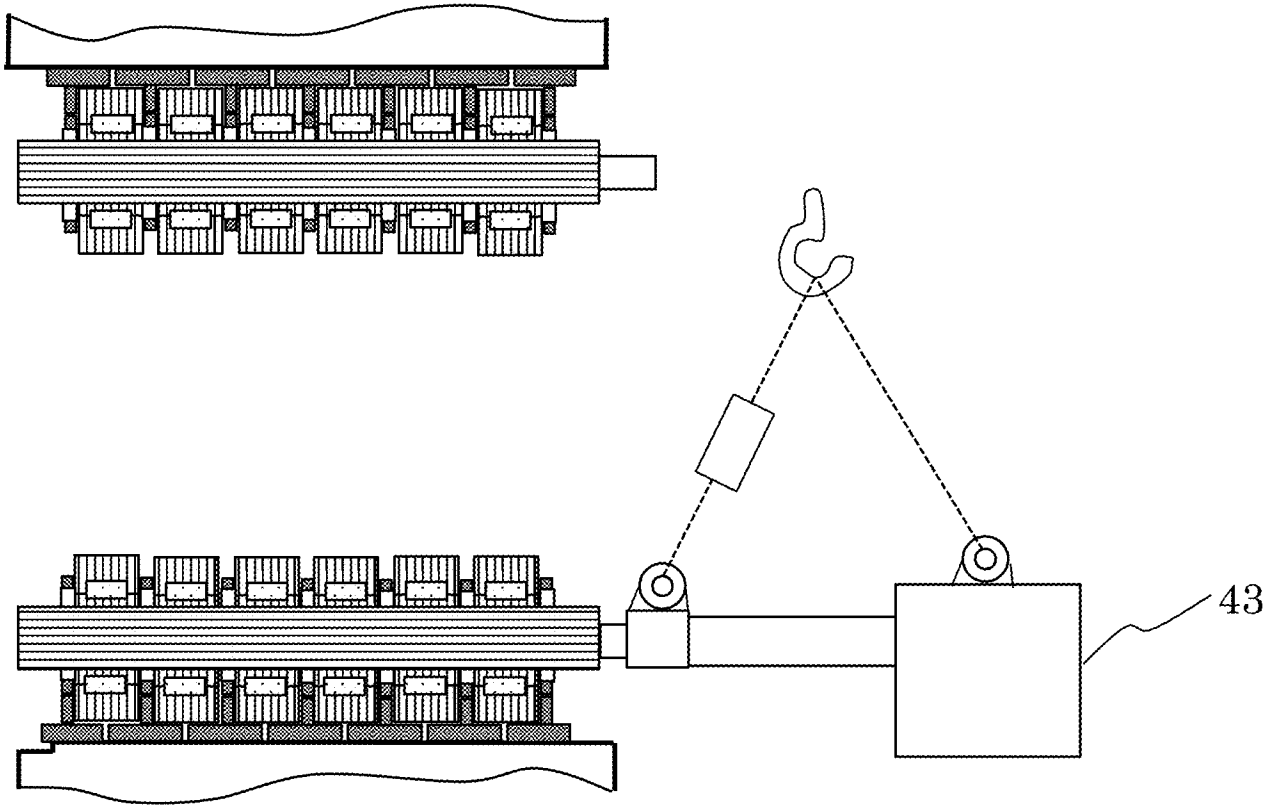
FIG. 5 is a diagram of assistance in explaining a state at a time of extracting lower divided bearing assembled shafts by the conventional porter bar.
Figure 6:
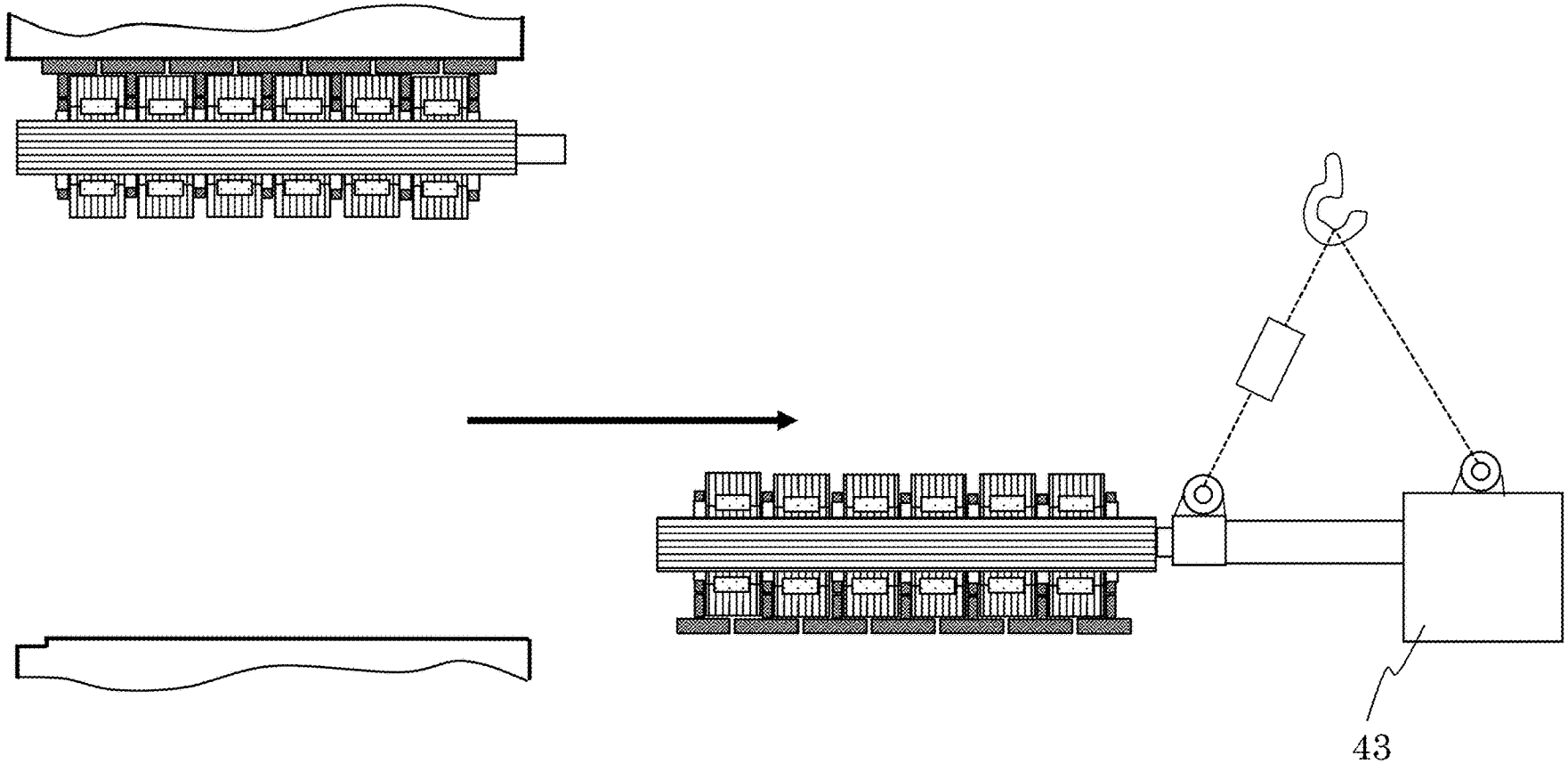
PRIOR ART Fig.6
FIG. 6 is a diagram of assistance in explaining a state after the lower divided bearing assembled shafts are extracted by the conventional porter bar.
Figure 7:
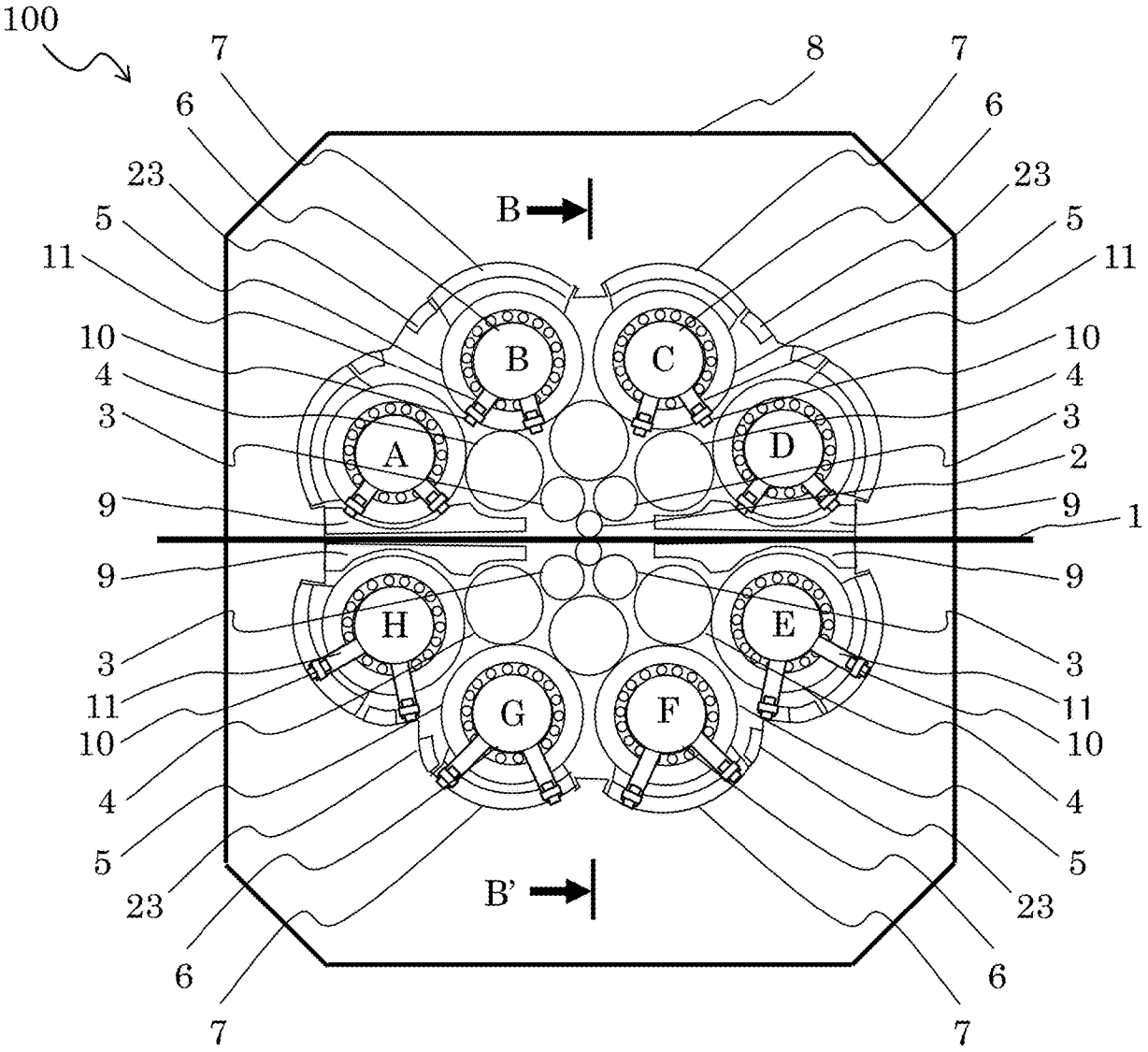
FIG. 7 is a front view of a 20-high rolling mill according to a first embodiment of the present invention.
Figure 8:
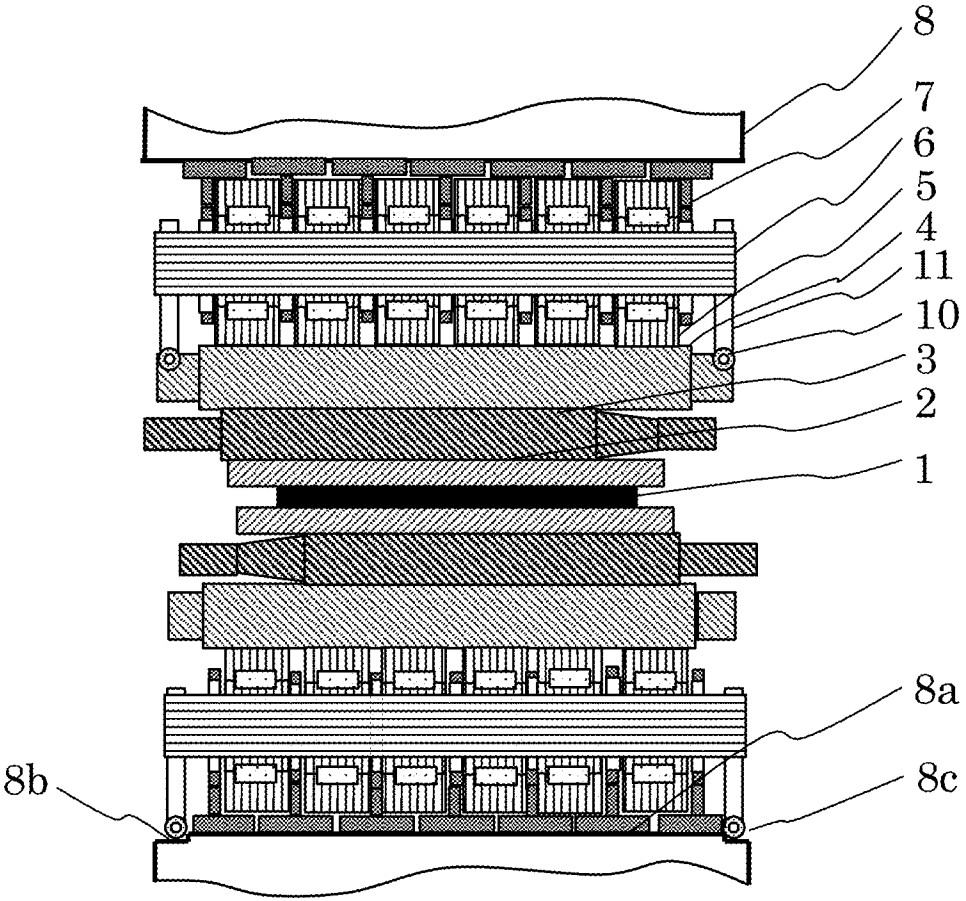
FIG. 8 is a sectional view taken in the direction of arrows B-B' in FIG. 7.
Figure 9:
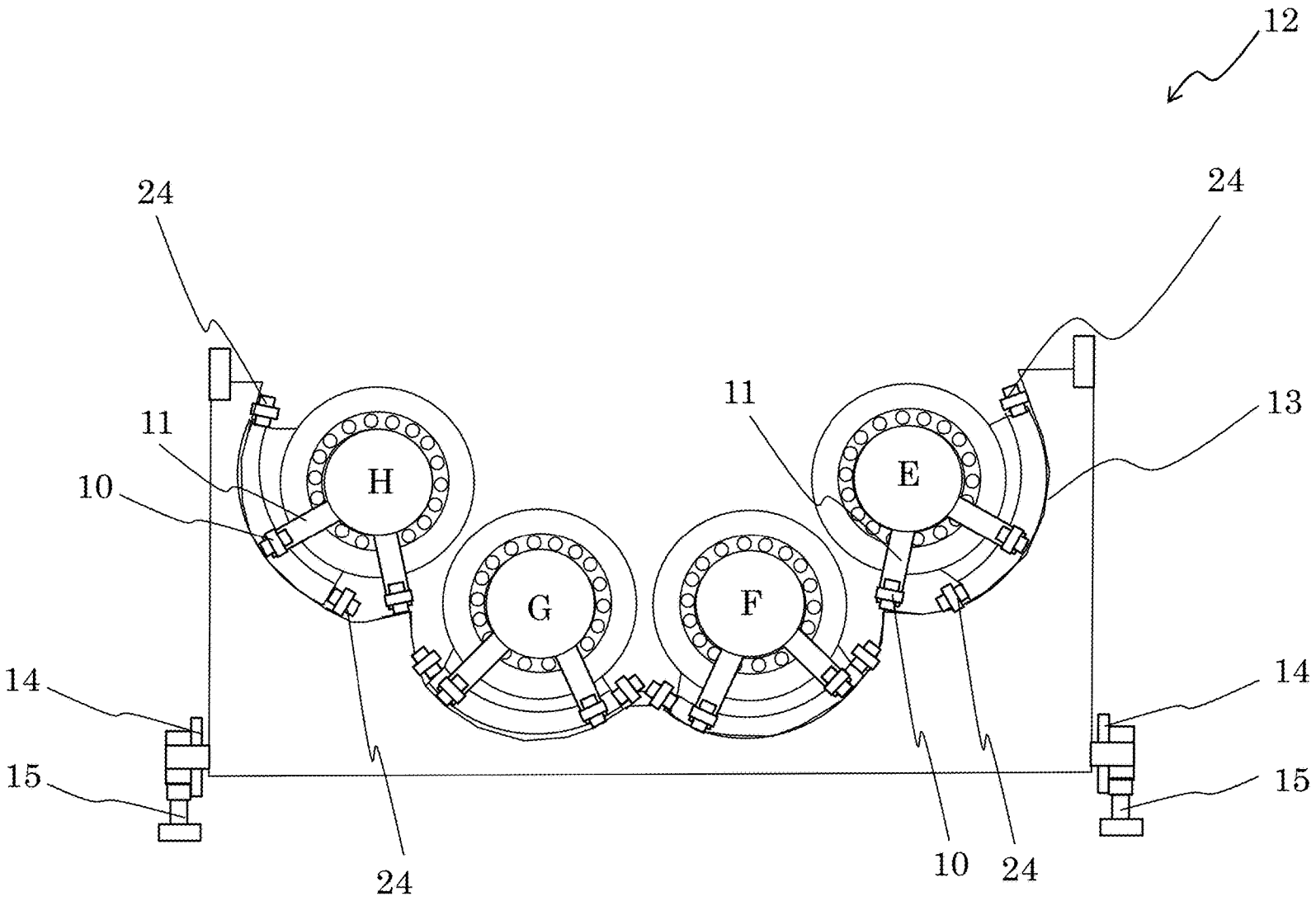
FIG. 9 is a diagram showing a section of a partial configuration of a changing carriage in the first embodiment.
Figure 10:
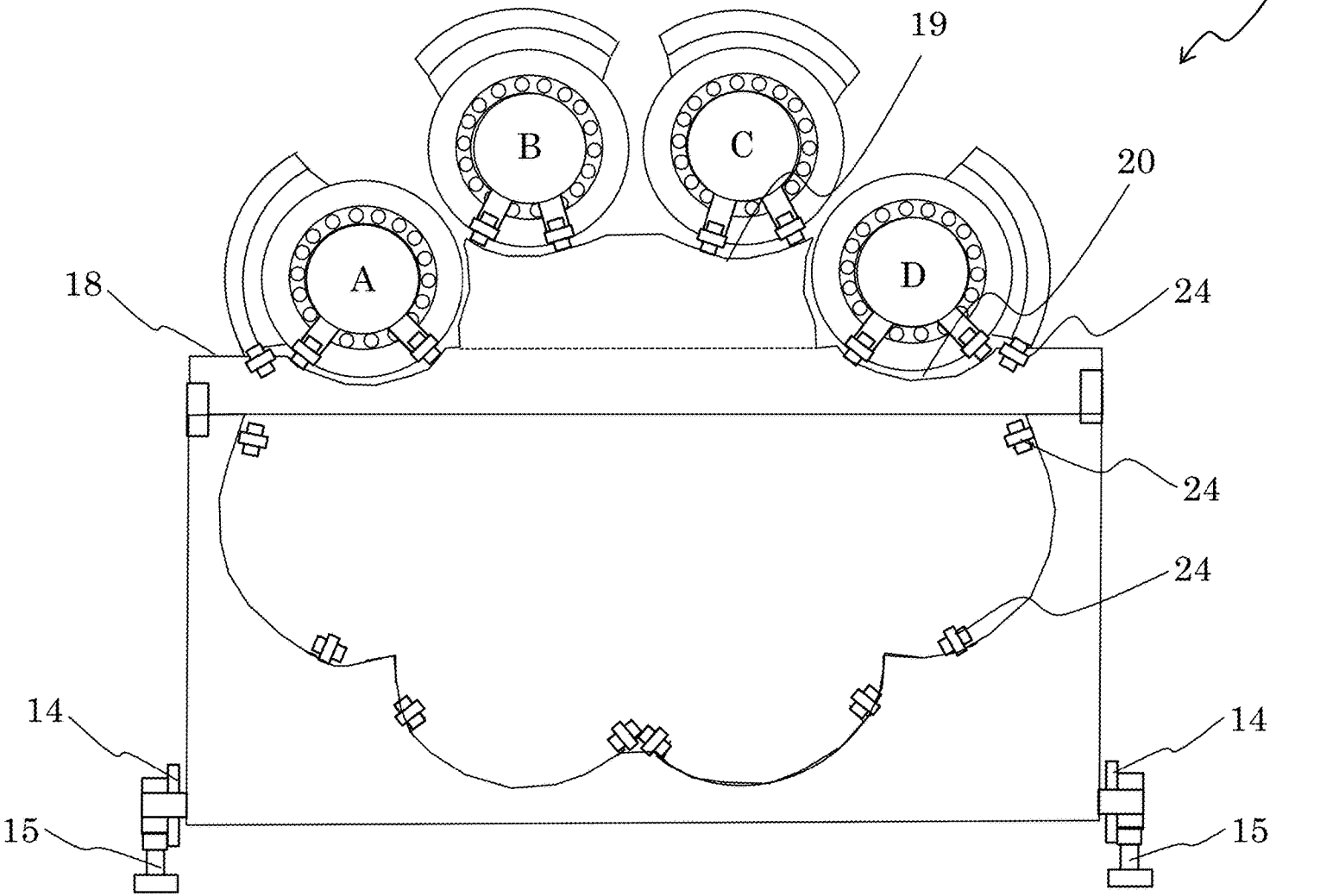
FIG. 10 is a diagram showing a section of a partial configuration of the changing carriage in the first embodiment.
Figure 11:
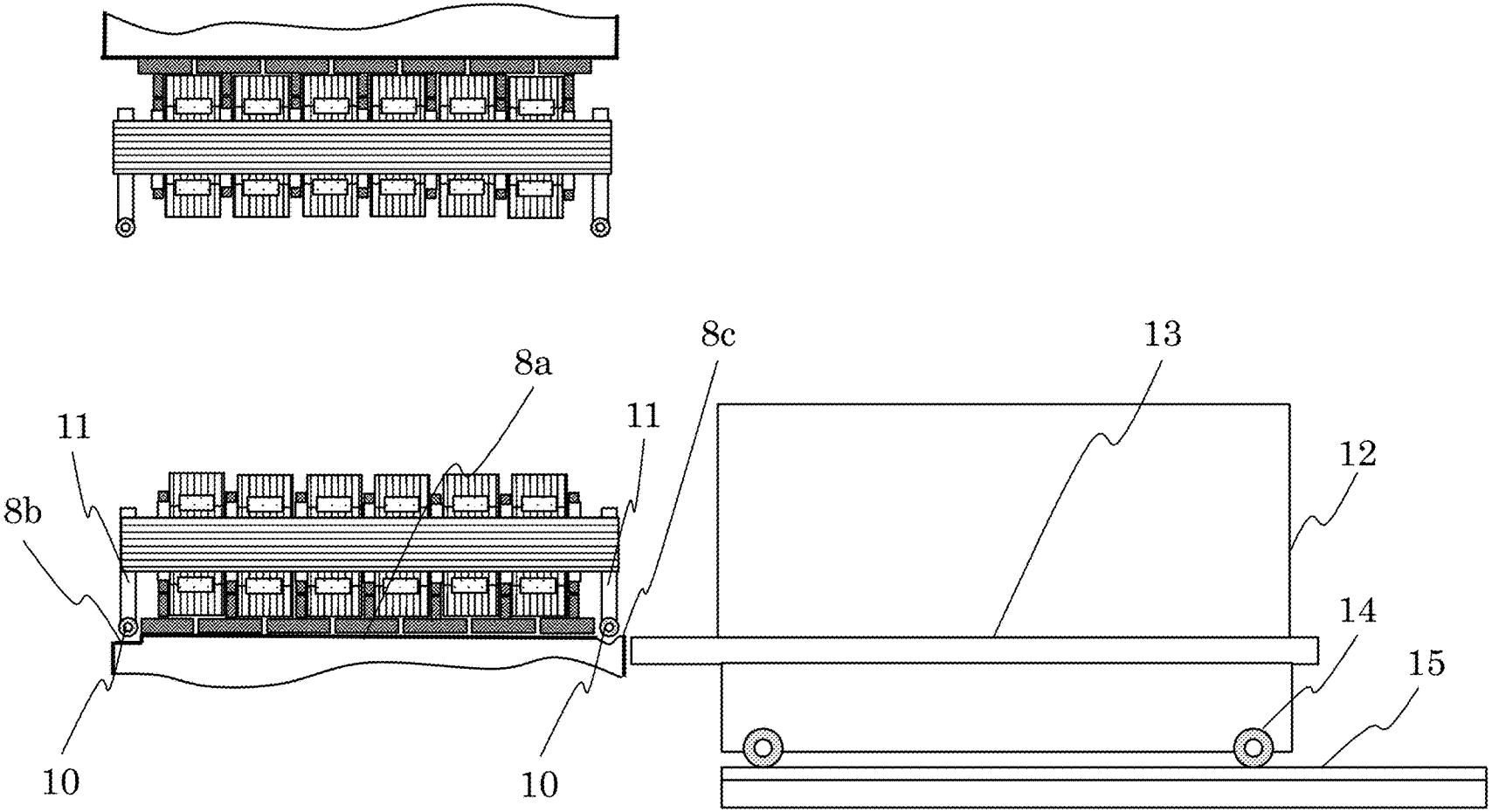
FIG. 11 is a diagram of assistance in explaining a state at a time of extracting lower divided bearing assembled shafts in the first embodiment.
Figure 12:
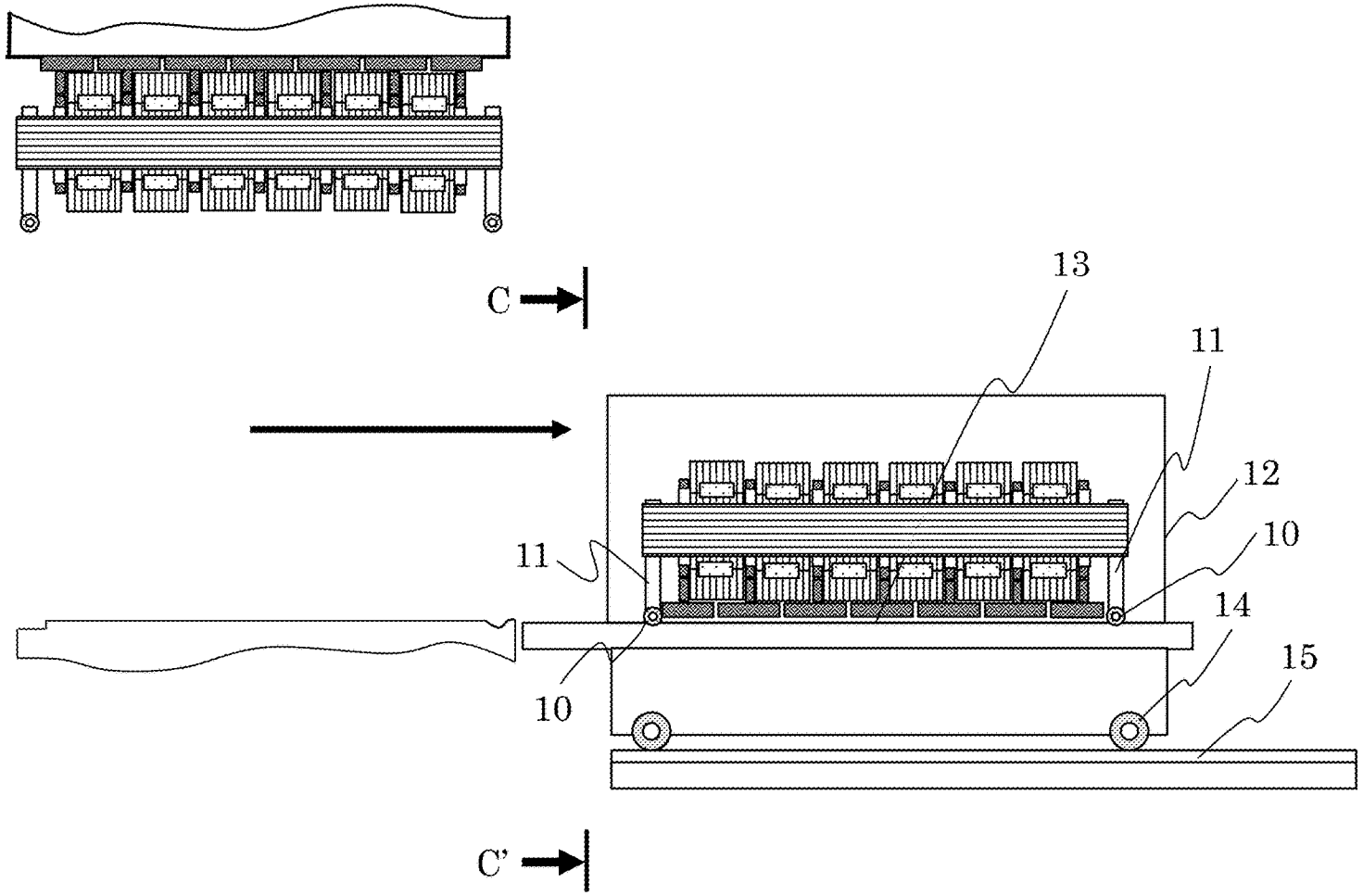
FIG. 12 is a diagram of assistance in explaining a state after the lower divided bearing assembled shafts are extracted in the first embodiment.
Figure 13:
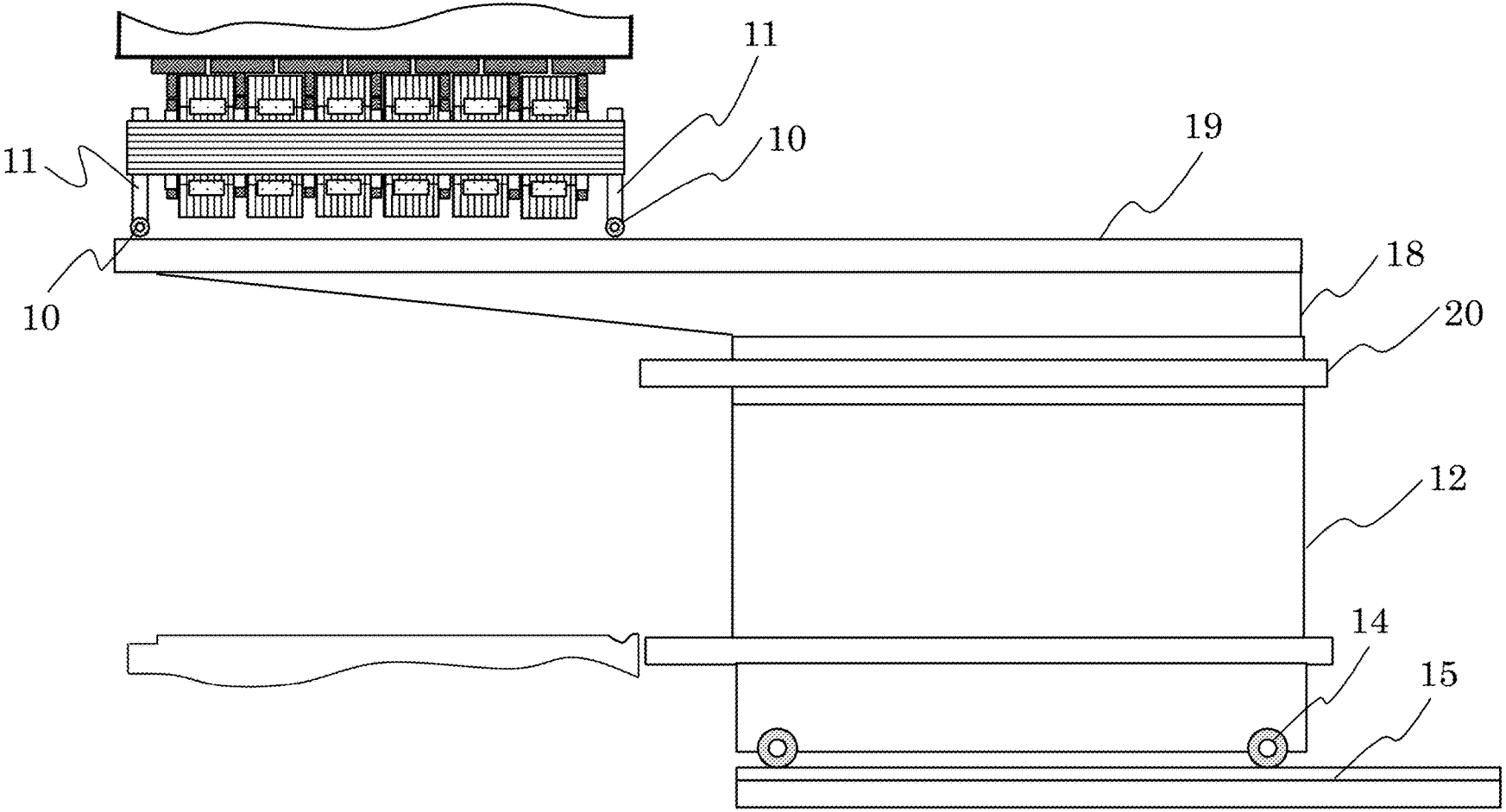
FIG. 13 is a diagram of assistance in explaining a state at a time of extracting upper divided bearing assembled shafts in the first embodiment.
Figure 14:
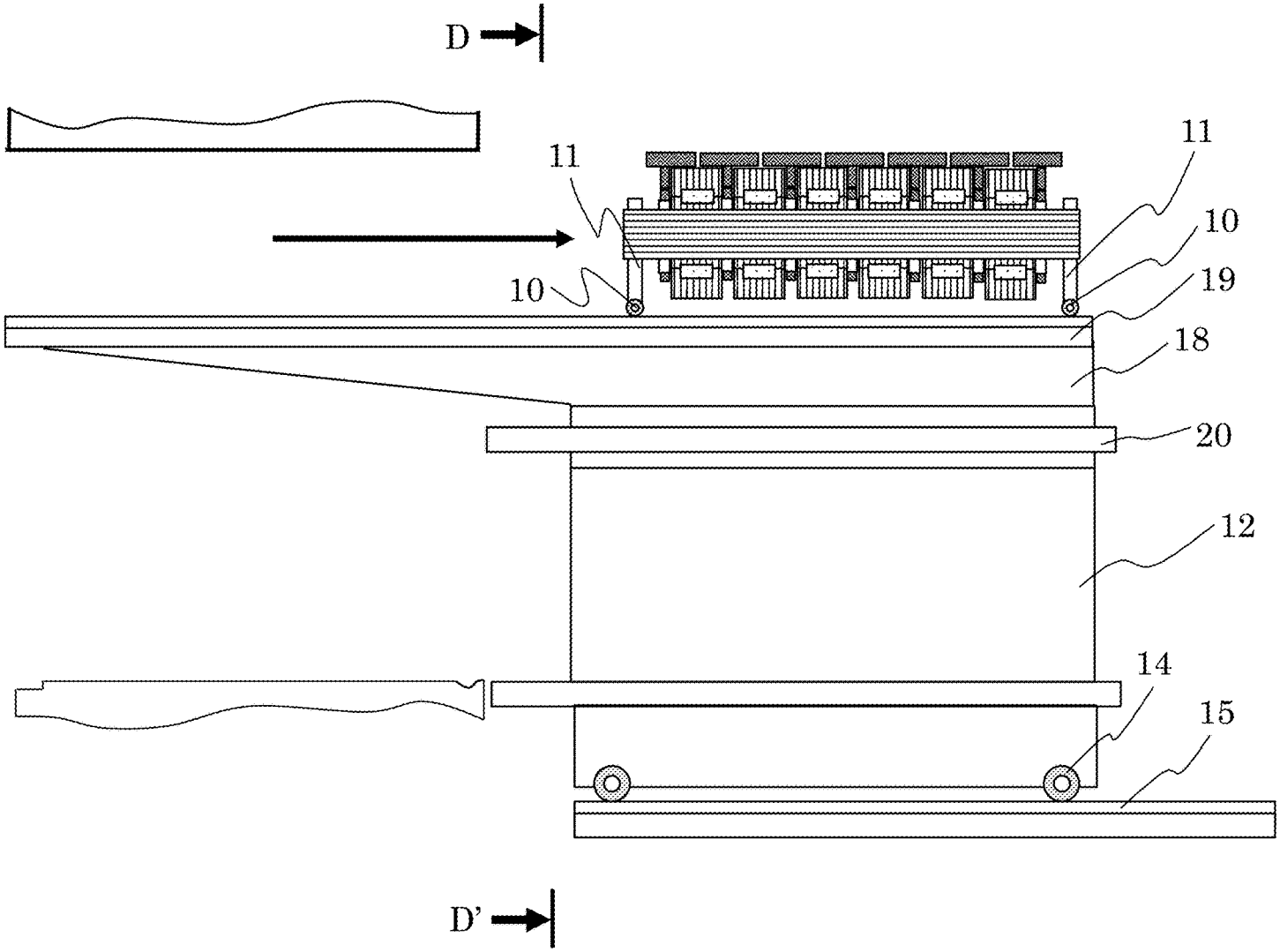
FIG. 14 is a diagram of assistance in explaining a state after the upper divided bearing assembled shafts are extracted in the first embodiment.
Figure 15:
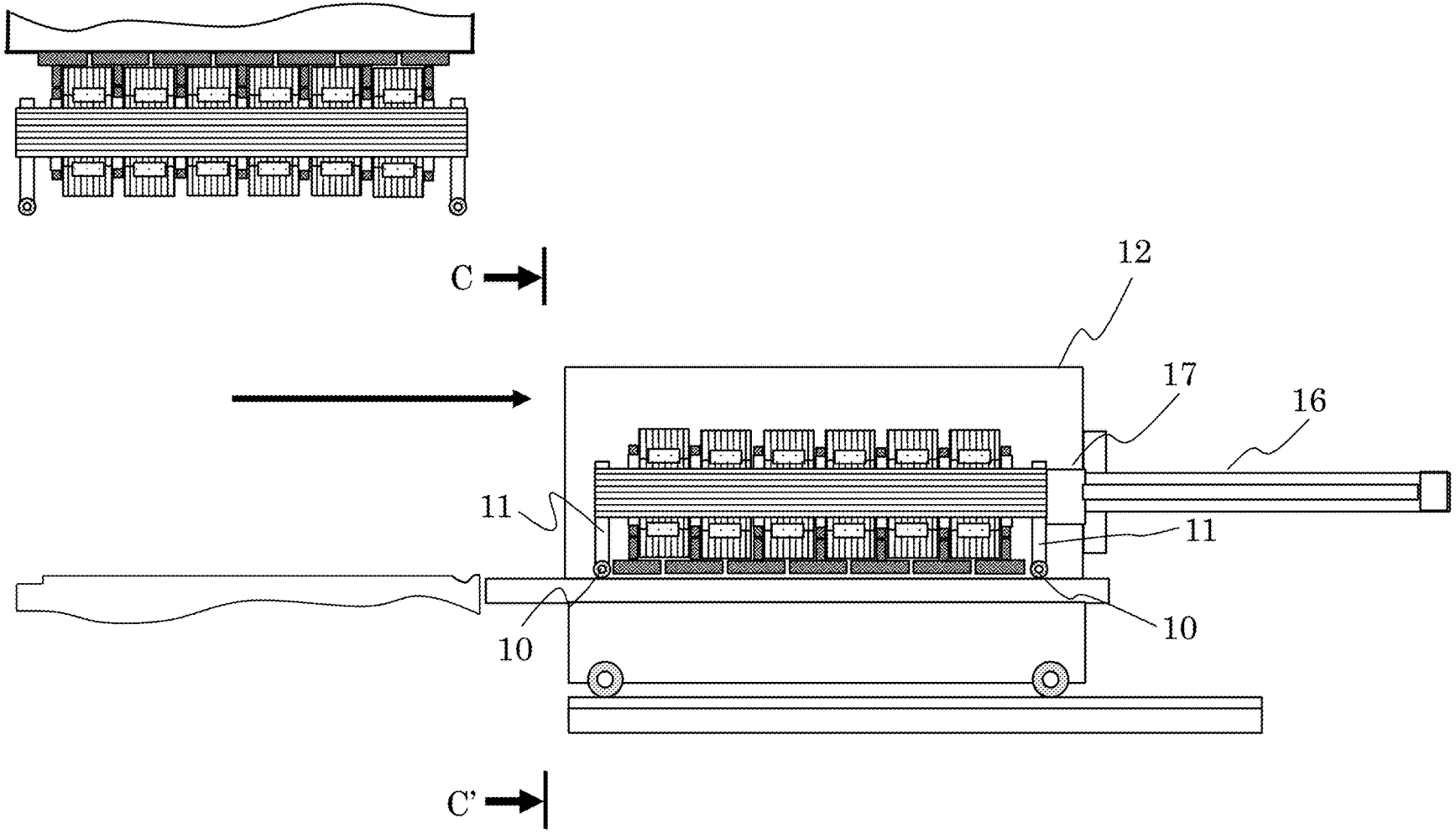
FIG. 15 is a diagram of assistance in explaining a state in the first embodiment, and is a diagram of assistance in explaining a state at a time of extracting the lower divided bearing assembled shafts.
Figure 16:
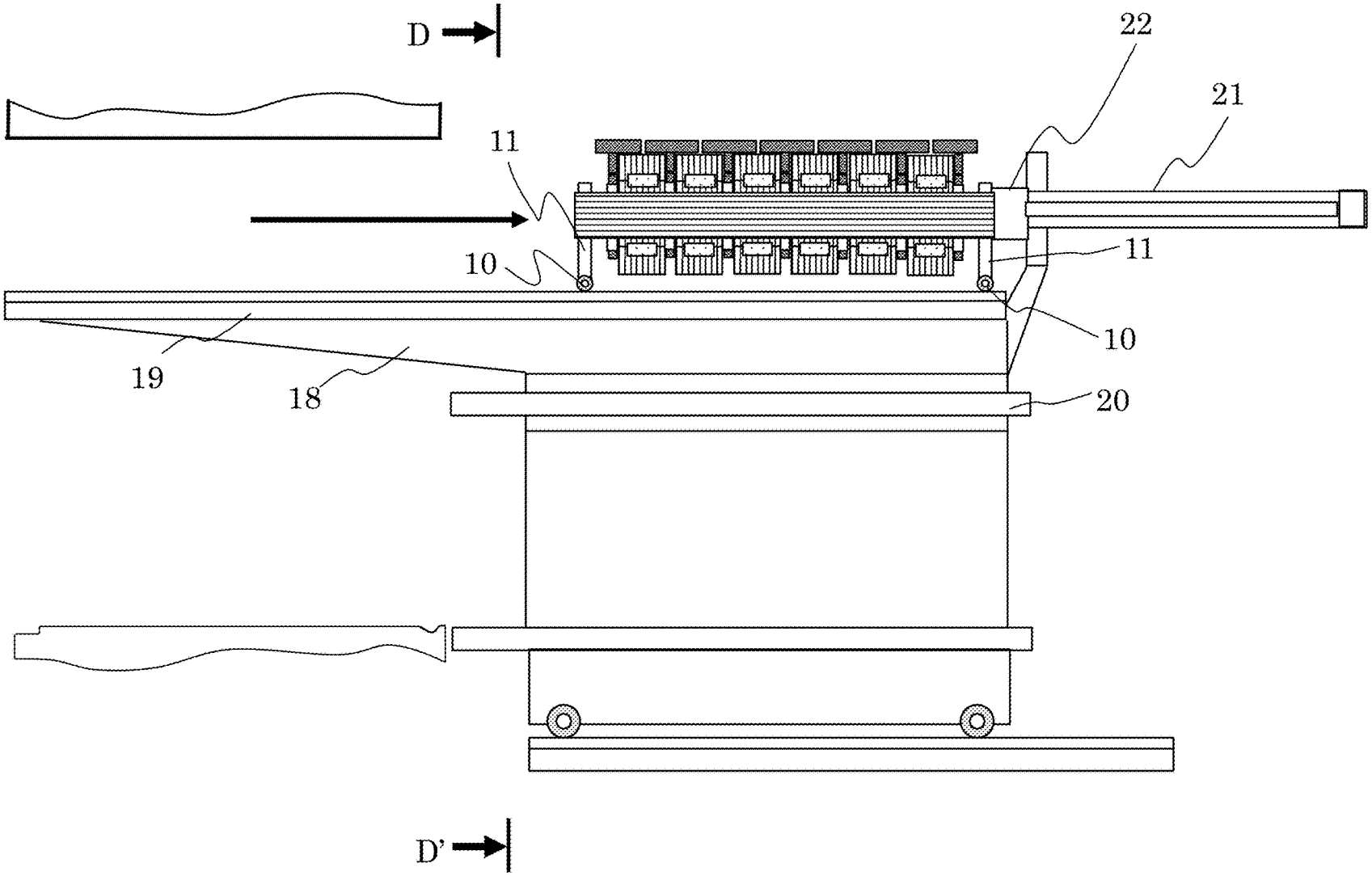
FIG. 16 is a diagram of assistance in explaining a state in the first embodiment, and is a diagram of assistance in explaining a state after the upper divided bearing assembled shafts are extracted.

FIG. 7 is a front view of a 20-high rolling mill according to the present embodiment. FIG. 8 is a sectional view taken in the direction of arrows B-B' in FIG. 7. FIG. 9 is a view showing a section of a part of a partial configuration of a changing carriage, the part corresponding to a section taken in the direction of arrows C-C' in FIG. 12 to be described later. FIG. 10 is a view showing a section of a part of a partial configuration of the changing carriage, the part corresponding to a section taken in the direction of arrows D-D' in FIG. 14 to be described later. FIG. 11 and FIG. 12 are diagrams of assistance in explaining states in extracting lower divided bearing assembled shafts. FIG. 13 and FIG. 14 are diagrams of assistance in explaining states in extracting upper divided bearing assembled shafts. FIG. 15 and FIG. 16 are diagrams of assistance in explaining states in extracting the divided bearing assembled shafts in another example.

As shown in FIG. 7, a multistage rolling mill 100 according to the present embodiment is a cluster type 20-high rolling mill for rolling a strip 1. In particular, the multistage rolling mill 100 is a rolling mill suitable for rolling a hard material such as a stainless steel sheet, an electrical steel sheet, a copper alloy, or the like.

In FIG. 7, the multistage rolling mill 100 includes: a pair of upper and lower work rolls 2 as rolls; two pairs of upper and lower first intermediate rolls 3; three pairs of upper and lower second intermediate rolls 4; four pairs of upper divided backing bearing assembled shafts A, B, C, and D and lower divided backing bearing assembled shafts E, F, G, and H that include a divided backing bearing 5, a shaft 6, and a saddle 7.

As shown in FIG. 7 and FIG. 8, the pair of upper and lower work rolls 2 rolls the strip 1 as a material to be rolled.

This pair of upper and lower work rolls 2 is respectively in contact with and supported by the two pairs of upper and lower first intermediate rolls 3. In addition, the two pairs of upper and lower first intermediate rolls 3 are respectively in contact with and supported by the three pairs of upper and lower second intermediate rolls 4.

In the present embodiment, the first intermediate rolls 3 and the second intermediate rolls 4 constitute an intermediate roll group that supports the work rolls 2.

Further, in the multistage rolling mill 100 according to the present embodiment, the three pairs of upper and lower second intermediate rolls 4 are respectively in contact with and supported by the upper divided backing bearing assembled shafts A, B, C, and D and the lower divided backing bearing assembled shafts E, F, G, and H.

These eight divided backing bearing assembled shafts are each supported by a single mono-block housing 8 via the saddle 7 thereof, and are fixed to the mono-block housing 8 via a clamp operation of a saddle clamp 23.

In addition, the eight divided backing bearing assembled shafts in the multistage rolling mill 100 according to the present embodiment are each provided with a total of four arms 11, that is, two arms 11 provided to an end portion on a drive side of the shaft 6, the two arms 11 being provided with a single wheel 10, and a total of two arms 11 provided also to an end portion on an work side of the shaft 6, the two arms 11 being provided with a single wheel 10.

The wheels 10 correspond to sliding apparatusespecifically, the wheels 10 roll on rails 13, 19, and 20 to be described later.

Incidentally, while it suffices to provide the arms 11 and the wheels 10 on at least only the drive side of the divided backing bearing assembled shafts, it is preferable from a viewpoint of workability to provide the arms 11 and the wheels 10 on both the drive side and the work side.

In addition, while description has been made of a case where the numbers of arms 11 and wheels 10 provided to one end portion of one divided backing bearing assembled shaft are two, the numbers may be one, or may be three or more.

That is, while it suffices to provide at least one arm 11 and one wheel 10 for one divided backing bearing assembled shaft, it is preferable to provide two or more arms 11 and two or more wheels 10 on at least both end sides of the shaft 6 for stable changing work.

Here, the wheels 10 on the side of the first lower divided backing bearing assembled shaft E, the second lower divided backing bearing assembled shaft F, the third lower divided backing bearing assembled shaft G, and the fourth lower divided backing bearing assembled shaft H on a lower side among the eight divided backing bearing assembled shafts are provided with notch grooves 8*c* and 8*b* in respective end portions on the work side and the drive side of a housing bore upper surface 8*a* of the mono-block housing 8, as shown in FIG. 8, so as not to apply a high load to the wheels 10 during rolling.

Similarly, the wheels 10 of the first upper divided backing bearing assembled shaft A and the fourth upper divided backing bearing assembled shaft D on an upper side are provided with notch grooves (omitted for the convenience of illustration) in end portions on the work side and the drive side of spray frame upper surfaces 9 attached to the mono-block housing 8 so as not to apply a high load to the wheels during rolling.

Further, as shown in FIGS. 9 to 12, the multistage rolling mill 100 according to the present embodiment is provided with a changing carriage 12 on the work side of the mono-block housing 8.

Divided backing bearing assembled shaft changing rails 13 having the same shape and the same size as the housing bore upper surface 8*a* of the mono-block housing 8 as shown in FIG. 9 are attached to the upper surface side of the changing carriage 12. Thus, the first lower divided backing bearing assembled shaft E, the second lower divided backing bearing assembled shaft F, the third lower divided backing bearing assembled shaft G, and the fourth lower divided backing bearing assembled shaft H can be moved horizontally without being moved in a vertical direction.

In addition, as shown in FIG. 10, an attachment 18 on which divided backing bearing assembled shaft changing rails 19 and 20 are formed can be detached from and attached to the changing carriage 12.

The upper surfaces of the divided backing bearing assembled shaft changing rails 19 are formed so as to allow the second upper divided backing bearing assembled shaft B and the third upper divided backing bearing assembled shaft C to be moved horizontally without being moved in the vertical direction.

The upper surfaces of the divided backing bearing assembled shaft changing rails 20 are formed in the same shape and the same size as the spray frame upper surfaces 9 so as to allow the first upper divided backing bearing assembled shaft A and the fourth upper divided backing bearing assembled shaft D to be moved horizontally without being moved in the vertical direction.

Further, parts of the divided backing bearing assembled shaft changing rails 13, 19, and 20 of the changing carriage 12 are provided with a plurality of saddle guide rollers 24, as shown in FIG. 9 and FIG. 10. Thus, the eight divided backing bearing assembled shafts can be moved in a rolling manner more smoothly without being rotated.

A lower portion of the changing carriage 12 is provided with a plurality of wheels 14. The changing carriage 12 can thereby travel so as to approach or separate from the multistage rolling mill 100 along rails 15 formed on a floor of facilities or the like in which the multistage rolling mill 100 is installed.

Incidentally, while description has been made of a case where the wheels 10 provided to distal ends of the arms 11 are used as the sliding apparatuses provided to the eight divided backing bearing assembled shafts in FIG. 7 and the like, the sliding apparatuses are not limited to the wheels 10.

For example, a mode can be adopted in which in place of the wheels 10, sleds are provided to the distal end sides of the arms 11, and the eight divided backing bearing assembled shafts are each moved by moving the sleds in a sliding manner on the housing bore upper surface 8*a* and the spray frame upper surfaces 9 or the rails 13, 19, and 20.

Incidentally, in this case, it is preferable to provide sliding liners in place of the saddle guide rollers 24.

A method of changing the divided backing bearing assembled shafts in the multistage rolling mill 100 according to the present embodiment will next be described with reference to FIGS. 11 to 16.

The work rolls 2, the first intermediate rolls 3, and the second intermediate rolls 4 can be extracted by publicly known various means such as a manual operation and the like.

Description will first be made of a method of changing the first lower divided backing bearing assembled shaft E, the second lower divided backing bearing assembled shaft F, the third lower divided backing bearing assembled shaft G, and the fourth lower divided backing bearing assembled shaft H among the eight divided backing bearing assembled shafts.

First, clamp operation of the saddle clamps 23 is released.

Thereafter, as shown in FIG. 11 and FIG. 12, within the mono-block housing 8, the first lower divided backing bearing assembled shaft E, the second lower divided backing bearing assembled shaft F, the third lower divided backing bearing assembled shaft G, and the fourth lower divided backing bearing assembled shaft H are manually moved in a rolling manner on the housing bore upper surface 8*a* by the wheels 10.

In addition, outside the mono-block housing 8, as shown in FIG. 12, the first lower divided backing bearing assembled shaft E, the second lower divided backing bearing assembled shaft F, the third lower divided backing bearing assembled shaft G, and the fourth lower divided backing bearing assembled shaft H can be extracted from the mono-block housing 8 by being manually moved in a rolling manner on the divided backing bearing assembled shaft changing rails 13 of the changing carriage 12 by the wheels 10.

Thereafter, the first lower divided backing bearing assembled shaft E, the second lower divided backing bearing assembled shaft F, the third lower divided backing bearing assembled shaft G, and the fourth lower divided backing bearing assembled shaft H are each lifted and moved by an overhead travelling crane or the like.

In addition, a new first lower divided backing bearing assembled shaft E, a new second lower divided backing bearing assembled shaft F, a new third lower divided backing bearing assembled shaft G, and a new fourth lower divided backing bearing assembled shaft H are respectively mounted on the divided backing bearing assembled shaft changing rails 13 of the changing carriage 12.

Thereafter, the new first lower divided backing bearing assembled shaft E, the new second lower divided backing bearing assembled shaft F, the new third lower divided backing bearing assembled shaft G, and the new fourth lower divided backing bearing assembled shaft H are manually moved in a rolling manner on the divided backing bearing assembled shaft changing rails 13 by the wheels 10 outside the mono-block housing 8, and are inserted into the mono-block housing 8 by being manually moved in a rolling manner on the housing bore upper surface 8*a* by the wheels 10 within the mono-block housing 8.

After the insertion, clamp operation of the saddle clamps 23 is performed. The changing work is then ended.

Description will next be made of a method of changing the first upper divided backing bearing assembled shaft A, the second upper divided backing bearing assembled shaft B, the third upper divided backing bearing assembled shaft C, and the fourth upper divided backing bearing assembled shaft D.

First, clamp operation of the saddle clamp 23 is released.

Thereafter, as shown in FIG. 10, the attachment 18 to which the divided backing bearing assembled shaft changing rails 19 and the divided backing bearing assembled shaft changing rails 20 are attached is mounted on an upper portion of the changing carriage 12.

Thereafter, as shown in FIG. 13 and FIG. 14, within the mono-block housing 8, the first upper divided backing bearing assembled shaft A and the fourth upper divided backing bearing assembled shaft D are manually moved in a rolling manner on the spray frame upper surfaces 9 by the wheels 10.

In addition, outside the mono-block housing 8, the first upper divided backing bearing assembled shaft A and the fourth upper divided backing bearing assembled shaft D can be extracted from the mono-block housing 8 by being manually moved in a rolling manner on the divided backing bearing assembled shaft changing rails 20 of the attachment 18 on the changing carriage 12 by the wheels 10.

In addition, within and outside the mono-block housing 8, as shown in FIG. 14, the second upper divided backing bearing assembled shaft B and the third upper divided backing bearing assembled shaft C can be extracted from the mono-block housing 8 by being manually moved in a rolling manner on the divided backing bearing assembled shaft changing rails 19 of the attachment 18 on the changing carriage 12 by the wheels 10.

Thereafter, the first upper divided backing bearing assembled shaft A, the second upper divided backing bearing assembled shaft B, the third upper divided backing bearing assembled shaft C, and the fourth upper divided backing bearing assembled shaft D are each lifted and moved by an overhead travelling crane or the like.

In addition, a new first upper divided backing bearing assembled shaft A, a new second upper divided backing bearing assembled shaft B, a new third upper divided backing bearing assembled shaft C, and a new fourth upper divided backing bearing assembled shaft D can be respectively mounted on the divided backing bearing assembled shaft changing rails 19 and 20 of the changing carriage 12, and inserted into the mono-block housing 8 by a reverse operation to that at the time of the extraction.

Incidentally, as shown in FIG. 15, the operations of extracting and inserting the lower divided backing bearing assembled shafts E, F, G, and H can be performed via a clamp device 17 by a hydraulic cylinder or a motor cylinder 16 attached to the changing carriage 12.

In addition, as shown in FIG. 16, the operations of extracting and inserting the upper divided backing bearing assembled shafts A, B, C, and D can be performed via a clamp device 22 by a hydraulic cylinder or a motor cylinder 21 attached to the attachment 18 on the changing carriage 12.

Effects of the present embodiment will next be described.

The cluster type multistage rolling mill 100 according to the first embodiment of the present invention described above includes: the pair of work rolls 2 configured to roll the strip 1; the intermediate roll group configured to support the work rolls 2; the plurality of divided backing bearing assembled shafts configured to support the intermediate roll group, the plurality of divided backing bearing assembled shafts each including the divided backing bearing 5, the shaft 6, and the saddle 7; the housing configured to support the saddles 7; the sliding apparatuses arranged on at least the drive side of the divided backing bearing assembled shafts; and the changing carriage 12 disposed on the work side of the housing, the changing carriage 12 having the rails 13, 19, and 20 capable of being loaded with the divided backing bearing assembled shafts, within the housing, the divided backing bearing assembled shafts each being moved on one of the housing bore upper surface 8*a* constituting the housing, the spray frame upper surfaces 9, and the rails 13, 19, and 20 of the changing carriage 12 by the sliding apparatuses, and outside the housing, the divided backing bearing assembled shafts being extracted from within the housing or inserted into the housing by being moved on the rails 13, 19, and 20 of the changing carriage 12 by the sliding apparatuses.

Thus, in the cluster type multistage rolling mill particularly suitable for a hard material such as a stainless steel sheet, an electrical steel sheet, a copper alloy, or the like, the sliding apparatuses are provided to the divided backing bearing assembled shafts, and the changing carriage providing excellent operability is provided which can move the divided backing bearing assembled shafts in a horizontal direction. It is thereby possible to change the divided backing bearing assembled shafts without using a porter bar hung by an overhead travelling crane. Thus, workability can be improved significantly.

In addition, the sliding apparatuses are either wheels 10 rolling on the rails 13, 19, and 20 or sleds moving by sliding on the rails 13, 19, and 20. Thus, the divided backing bearing assembled shafts can be moved horizontally by a simple structure and without application of a large force. Changing work can therefore be performed more easily.

In addition, upper surfaces of the changing carriage 12, the rails 13, 19, and 20 being arranged on the upper surfaces, have the same shape and the same size as the housing bore upper surface 8*a* or the spray frame upper surfaces 9. Thus, the divided backing bearing assembled shafts can be horizontally moved more stably. The changing work can therefore be performed more easily.

Further, the sliding apparatuses are arranged on the drive side and the work side of the divided backing bearing assembled shafts. Thus, the divided backing bearing assembled shafts can be horizontally moved more accurately and surely. The changing work can therefore be performed even more easily.

Second Embodiment

Figure 17:
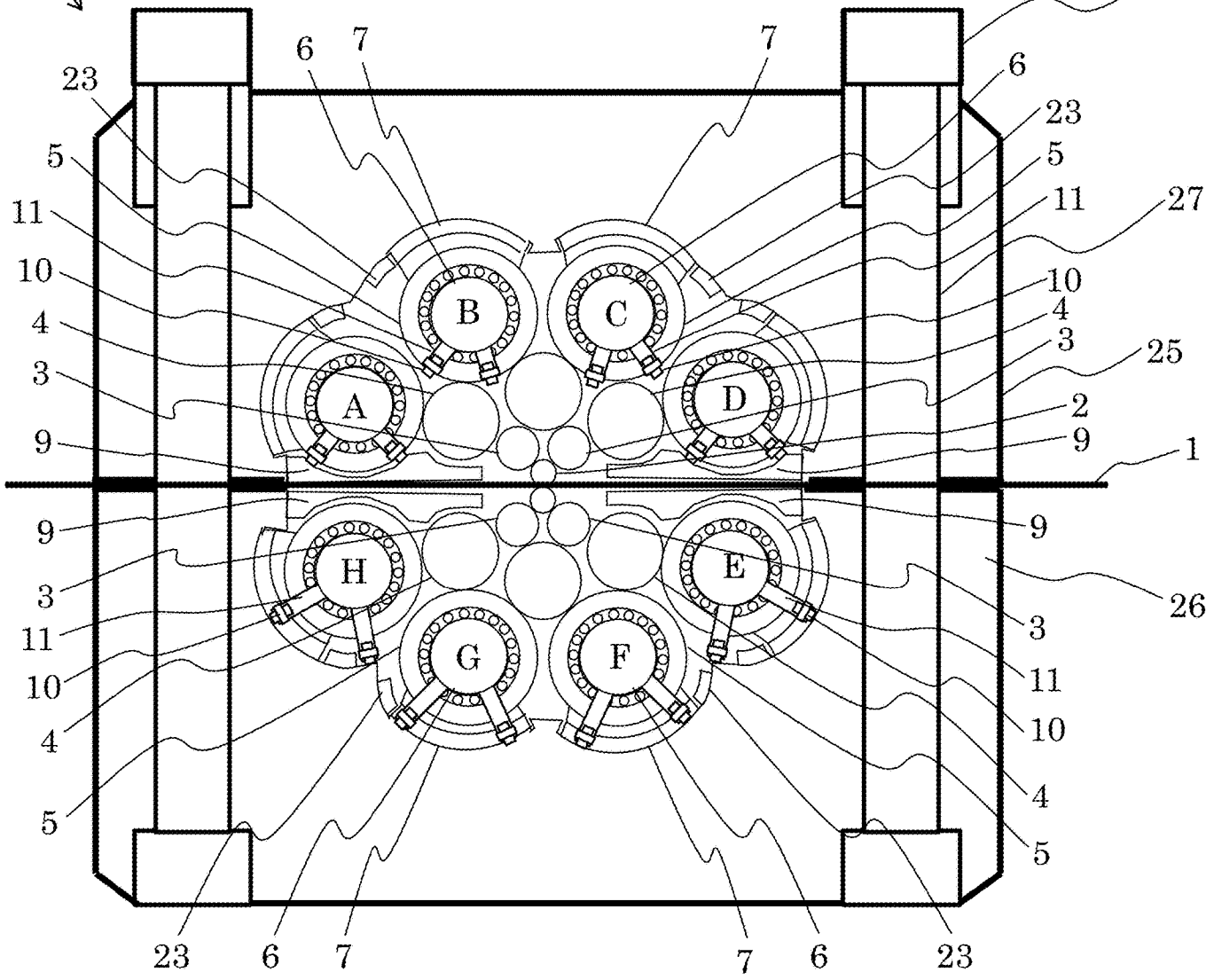
FIG. 17 is a front view of a 20-high rolling mill according to a second embodiment of the present invention.

A rolling mill according to a second embodiment of the present invention and a method of changing divided backing bearing assembled shafts in the rolling mill will be described with reference to FIG. 17. FIG. 17 is a front view of a 20-high rolling mill according to the present embodiment.

Incidentally, in the present embodiment, the same configurations as in the first embodiment are indicated by the same reference numerals, and description thereof will be omitted. The same is true for subsequent embodiments.

As shown in FIG. 17, a housing of a multistage rolling mill 100A according to the present embodiment is formed by an upper mill housing 25 and a lower mill housing 26 in place of the mono-block housing 8 of the multistage rolling mill 100 according to the first embodiment.

In addition, the upper mill housing 25 and the lower mill housing 26 are coupled to each other in a state of being prestressed by four prestress cylinders 28 and tie rods 27.

Other configurations and operations are substantially the same configurations and operations as those of the rolling mill according to the foregoing first embodiment and the method of changing the divided backing bearing assembled shafts in the rolling mill, and therefore details thereof will be omitted.

The rolling mill according to the second embodiment of the present invention and the method of changing the divided backing bearing assembled shafts in the rolling mill also provide substantially similar effects to those of the foregoing first embodiment.

In addition, during rolling, because of the prestress load of the prestress cylinders 28 and the tie rods 27, the multistage rolling mill 100A according to the present embodiment provides effects of being able to secure high mill stiffness, and thus roll a sheet of high quality with excellent sheet thickness accuracy. In addition, an effect of further facilitating sheet passage and roll changing is obtained because the prestress cylinders 28 are opened and the upper mill housing 25 is opened greatly at a time of the sheet passage and at a time of the roll changing.

Incidentally, while an example has been illustrated in which the upper mill housing 25 is raisably and lowerably coupled to the lower mill housing 26 by the tie rods 27 and the prestress cylinders 28, the coupling method is not limited to this. The upper mill housing 25 can be raisably and lowerably coupled to the lower mill housing 26 by tie rods and lifting and lowering cylinders or tie rods and worm screws as in a fourth embodiment to be described later.

Third Embodiment

Figure 18:
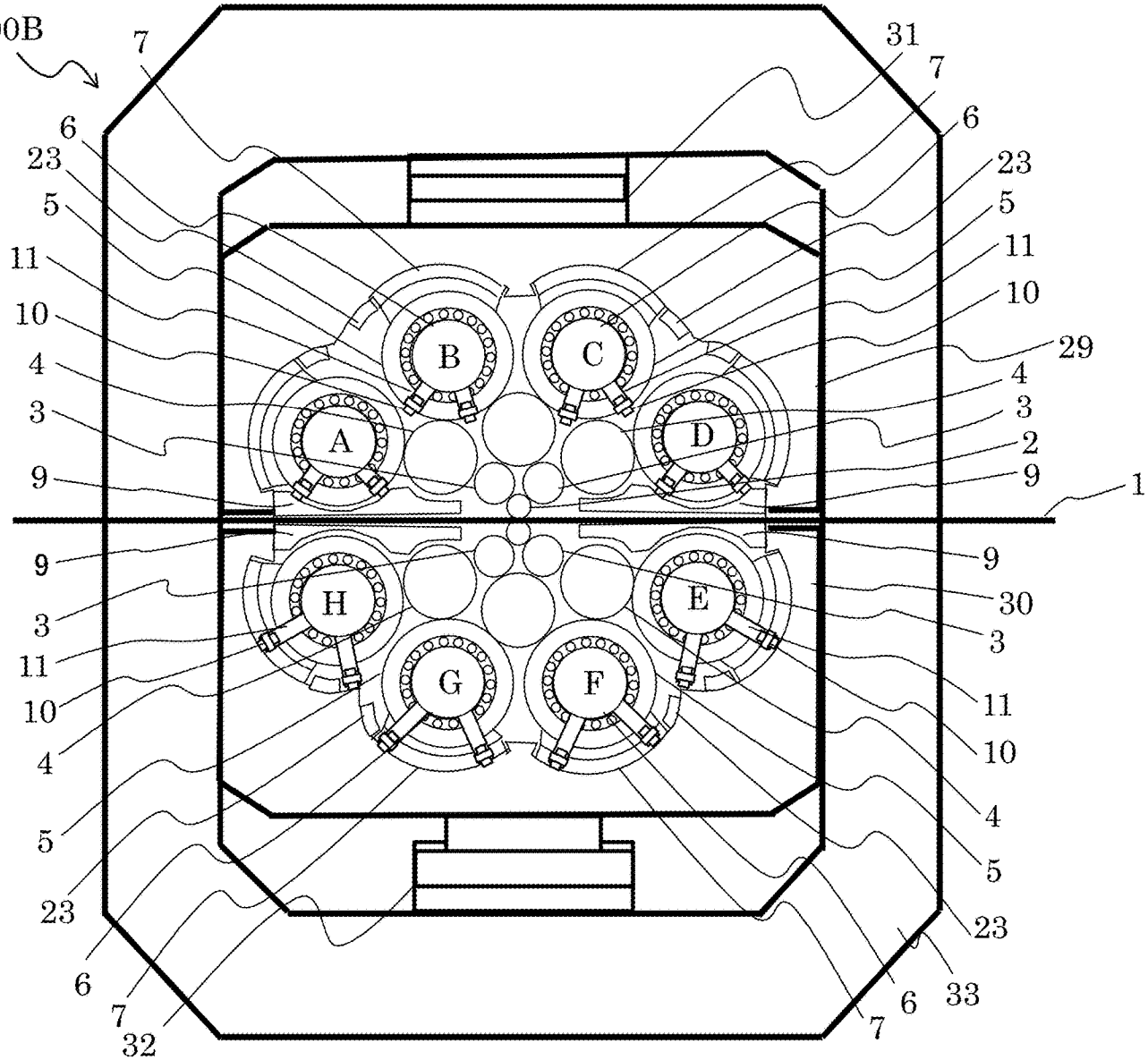
FIG. 18 is a front view of a 20-high rolling mill according to a third embodiment of the present invention.

A rolling mill according to a third embodiment of the present invention and a method of changing divided backing bearing assembled shafts in the rolling mill will be described with reference to FIG. 18. FIG. 18 is a front view of a 20-high rolling mill according to the present embodiment.

As shown in FIG. 18, in place of the mono-block housing 8 of the multistage rolling mill 100 according to the first embodiment, a housing of 100B according to the present embodiment includes an upper mill inner housing 29 and a lower mill inner housing 30.

In addition, a pass line adjusting device 31 is disposed on the work side and the drive side of an upper portion of the upper mill inner housing 29, and a main jack 32 is disposed on the work side and the drive side of a lower portion of the lower mill inner housing 30.

Further, the pass line adjusting device 31 and the main jack 32 are supported by a mill outer housing 33 on the work side and the drive side.

Other configurations and operations are substantially the same configurations and operations as those of the rolling mill according to the foregoing first embodiment and the method of changing the divided backing bearing assembled shafts in the rolling mill, and therefore details thereof will be omitted.

The rolling mill according to the third embodiment of the present invention and the method of changing the divided backing bearing assembled shafts in the rolling mill also provide effects substantially similar to those of the foregoing first embodiment.

In addition, the multistage rolling mill 100B according to the present embodiment provides an effect of being able to roll a sheet of high quality with excellent sheet thickness accuracy by the pressing of the main jack 32 having high responsiveness during rolling. In addition, an effect of facilitating sheet passage and roll changing is obtained because the main jack 32 is opened and thereby the lower mill inner housing 30 is opened greatly at a time of the sheet passage or at a time of the roll changing.

Fourth Embodiment

Figure 19:
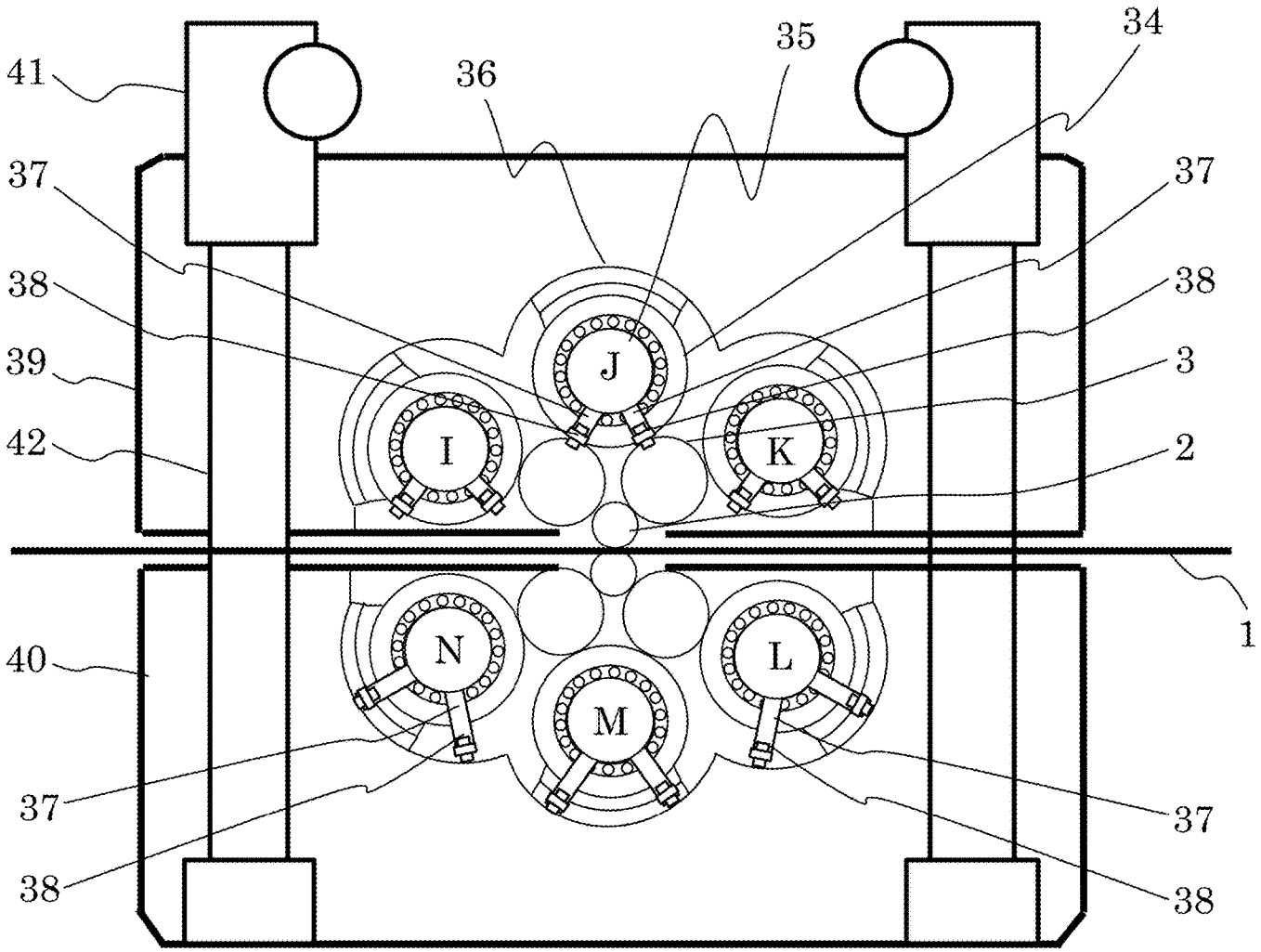
FIG. 19 is a front view of a 12-high rolling mill according to a fourth embodiment of the present invention.

A rolling mill according to a fourth embodiment of the present invention and a method of changing divided backing bearing assembled shafts in the rolling mill will be described with reference to FIG. 19. FIG. 19 is a front view of a 12-high rolling mill according to the present embodiment.

As shown in FIG. 19, a multistage rolling mill 100C according to the present embodiment is a cluster type 12-high rolling mill for rolling the strip 1.

As shown in FIG. 19, the multistage rolling mill 100C includes a pair of upper and lower work rolls 2, two pairs of upper and lower first intermediate rolls 3, and three pairs of upper divided backing bearing assembled shafts I, J, and K and lower divided backing bearing assembled shafts L, M, and N that include a divided backing bearing 34, a shaft 35, and a saddle 36.

The pair of upper and lower work rolls 2 is respectively in contact with and supported by the two pairs of upper and lower first intermediate rolls 3. In the present embodiment, the first intermediate rolls 3 constitute an intermediate roll group that supports the work rolls 2.

Further, in the multistage rolling mill 100C according to the present embodiment, the two pairs of upper and lower first intermediate rolls 3 are in contact with and supported by the upper divided backing bearing assembled shafts I, J, and K and the lower divided backing bearing assembled shafts L, M, and N.

Of these six divided backing bearing assembled shafts, the first upper divided backing bearing assembled shaft I, the second upper divided backing bearing assembled shaft J, and the third upper divided backing bearing assembled shaft K are supported by an upper mill housing 39 via the respective saddles 36.

Similarly, the first lower divided backing bearing assembled shaft L, the second lower divided backing bearing assembled shaft M, and the third lower divided backing bearing assembled shaft N are supported by a lower mill housing 40 via the respective saddles 36.

In addition, the upper mill housing 39 and the lower mill housing 40 are coupled to each other by four tie rods 42 and worm screws 41. Operation of the worm screws 41 can raise or lower the upper mill housing 39 with respect to the lower mill housing 40.

In addition, the six divided backing bearing assembled shafts in the multistage rolling mill 100C according to the present embodiment are each provided with a total of four arms 37, that is, a total of two arms 37 provided to an end portion on the drive side of the shaft 35, the two arms 37 being provided with a single wheel 38, and a total of two arms 37 provided also to an end portion on the work side of the shaft 35, the two arms 37 being provided with a single wheel 38.

Incidentally, as in the first embodiment, it suffices to provide at least one arm 37 and one wheel 38 to one divided backing bearing assembled shaft, and sleds can be provided to the end sides of the arms 37 in place of the wheels 38.

The method of changing the divided backing bearing assembled shafts in the multistage rolling mill 100C according to the present embodiment is similar to that of the first embodiment, and details thereof will be omitted.

Other configurations and operations are substantially the same configurations and operations as those of the rolling mill according to the foregoing first embodiment and the method of changing the divided backing bearing assembled shafts in the rolling mill, and therefore details thereof will be omitted.

The multistage rolling mill 100C, in which the intermediate roll group includes the two pairs of upper and lower first intermediate rolls 3 supporting the work rolls 2, the divided backing bearing assembled shafts are three pairs of upper and lower divided backing bearing assembled shafts and support the first intermediate rolls 3, and the housing includes the upper mill housing 39 and the lower mill housing 40 supporting the saddles 7, the tie rods 42, and the worm screws 41, as in the fourth embodiment of the present invention, and the method of changing the divided backing bearing assembled shafts also provide effects substantially similar to those of the foregoing first embodiment.

In addition, the multistage rolling mill 100C according to the present embodiment has an advantage of a small number of rolls.

<Others>

It is to be noted that the present invention is not limited to the foregoing embodiments, and includes various modifications. The foregoing embodiments are described in detail to describe the present invention in an easily understandable manner, and are not necessarily limited to embodiments including all of the described configurations.

In addition, a part of a configuration of a certain embodiment can be changed with a configuration of another embodiment, and a configuration of another embodiment can be added to a configuration of a certain embodiment. In addition, for a part of a configuration of each embodiment, another configuration can be added, deleted, or substituted.

For example, the method of changing the divided backing bearing assembled shafts according to the present invention described above can be applied by performing work of adding the changing carriage 12 and equipment accompanying the changing carriage 12 to an existing cluster type multistage rolling mill, and modifying the housing bore upper surface 8*a* of the mono-block housing 8, the spray frame upper surfaces 9, the saddles 7, the saddle clamps 23, and the like within the housing. Consequently, even the existing cluster type multistage rolling mill can also provide effects similar to those of the foregoing first embodiment or the like.

DESCRIPTION OF REFERENCE CHARACTERS

1 . . . Strip (metal strip)
2 . . . Work roll
3 . . . First intermediate roll
4 . . . Second intermediate roll
5, 34 . . . Divided backing bearing
6, 35 . . . Shaft
7, 36 . . . Saddle
8 . . . Mono-block housing
8*a* . . . Housing bore upper surface
8*b* . . . Groove
8*c* . . . Groove
9 . . . Spray frame upper surface
10, 38 . . . Wheel
11, 37 . . . Arm
12 . . . Changing carriage
13 . . . Divided backing bearing assembled shaft changing rail
14 . . . Wheel
15 . . . Rail
16 . . . Motor cylinder
17 . . . Clamp device
18 . . . Attachment
19 . . . Divided backing bearing assembled shaft changing rail
20 . . . Divided backing bearing assembled shaft changing rail
21 . . . Motor cylinder
22 . . . Clamp device
23 . . . Saddle clamp
24 . . . Saddle guide roller
25, 39 . . . Upper mill housing
26, 40 . . . Lower mill housing
27 . . . Tie rod
28 . . . Prestress cylinder
29 . . . Upper mill inner housing
30 . . . Lower mill inner housing
31 . . . Pass line adjusting device
32 . . . Main jack (main cylinder)
33 . . . Mill outer housing
41 . . . Worm screw (upper and lower mill housing coupling device)
42 . . . Tie rod (upper and lower mill housing coupling device)
100, 100A, 100B, 100C . . . Multistage rolling mill
A . . . First upper divided backing bearing assembled shaft
B . . . Second upper divided backing bearing assembled shaft
C . . . Third upper divided backing bearing assembled shaft
D . . . Fourth upper divided backing bearing assembled shaft
E . . . First lower divided backing bearing assembled shaft
F . . . Second lower divided backing bearing assembled shaft
G . . . Third lower divided backing bearing assembled shaft
H . . . Fourth lower divided backing bearing assembled shaft
I . . . First upper divided backing bearing assembled shaft
J . . . Second upper divided backing bearing assembled shaft
K . . . Third upper divided backing bearing assembled shaft
L . . . First lower divided backing bearing assembled shaft
M . . . Second lower divided backing bearing assembled shaft
N . . . Third lower divided backing bearing assembled shaft

The invention claimed is:

1. A cluster type multistage rolling mill comprising:

a pair of work rolls rolling a metal strip;

an intermediate roll group supporting the work rolls;

a plurality of divided backing bearing assembled shafts supporting the intermediate roll group, the plurality of divided backing bearing assembled shafts each including a divided backing bearing, a shaft, and a saddle;

a housing supporting the saddles;

sliding apparatuses arranged on at least a drive side of the divided backing bearing assembled shafts, the sliding apparatuses including wheels;

arms on the drive side and a work side of the divided backing bearing assembled shafts that respectively connect the divided backing bearing assembled shafts to the wheels, wherein the sliding apparatuses and arms are part of the divided backing bearing assembled shafts; and a changing carriage disposed on a work side of the housing, the changing carriage having rails capable of being loaded with the divided backing bearing assembled shafts, within the housing, the sliding apparatuses being configured to move the divided backing bearing assembled shafts with the wheels of the sliding apparatuses rolling on one of a housing bore upper surface constituting the housing, spray frame upper surfaces, and the rails of the changing carriage, and outside the housing, the sliding apparatuses being configured to move the divided backing bearing assembled shafts being extracted from within the housing or inserted into the housing with the wheels of the sliding apparatuses rolling on the rails of the changing carriage.

2. The multistage rolling mill according to claim 1, wherein the intermediate roll group includes two pairs of upper and lower first intermediate rolls supporting the work rolls and three pairs of upper and lower second intermediate rolls supporting the first intermediate rolls, the divided backing bearing assembled shafts comprise four pairs of upper and lower divided backing bearing assembled shafts that support the second intermediate rolls, and the housing is a mill housing.

3. The multistage rolling mill according to claim 1, wherein the intermediate roll group includes two pairs of upper and lower first intermediate rolls supporting the work rolls, the divided backing bearing assembled shafts comprise three pairs of upper and lower divided backing bearing assembled shafts that support the first intermediate rolls, and the housing includes an upper and a lower mill housing supporting the saddles and an upper and a lower mill housing coupling device.

4. The multistage rolling mill according to claim 1, wherein upper surfaces of the changing carriage, the rails being arranged on the upper surfaces, have a same shape and a same size as the housing bore upper surface or the spray frame upper surfaces.

5. The multistage rolling mill according to claim 1, wherein the sliding apparatuses are arranged on the drive side and the work side of the divided backing bearing assembled shafts.

6. The multistage rolling mill according to claim 2, wherein the mill housing is a single mono-block housing.

7. The multistage rolling mill according to claim 2, wherein the mill housing includes an upper mill housing and a lower mill housing, the upper mill housing and the lower mill housing are coupled to each other such that the upper mill housing is raisable and lowerable by at least any one from among tie rods and prestress cylinders, raising and lowering cylinders, and worm screws.

8. The multistage rolling mill according to claim 2, wherein the mill housing includes an upper mill inner housing, a pass line adjusting device supporting the upper mill inner housing, a lower mill inner housing, a main cylinder supporting the lower mill inner housing, and a mill outer housing supporting the pass line adjusting device and the main cylinder.

9. A method of changing divided backing bearing assembled shafts in a cluster type multistage rolling mill that rolls a metal strip, the multistage rolling mill including a pair of work rolls rolling the metal strip, an intermediate roll group supporting the work rolls, a plurality of divided backing bearing assembled shafts supporting the intermediate roll group, the plurality of divided backing bearing assembled shafts each including a divided backing bearing, a shaft, and a saddle, a housing supporting the saddles, sliding apparatuses arranged on at least a drive side of the divided backing bearing assembled shafts, the sliding apparatuses including wheels, arms on the drive side and a work side of the divided backing bearing assembled shafts that respectively connect the divided backing bearing assembled shafts to the wheels, and a changing carriage disposed on a work side of the housing, the changing carriage having rails capable of being loaded with the divided backing bearing assembled shafts, wherein the sliding apparatuses and arms are part of the divided backing bearing assembled shafts, the method comprising: moving each of the divided backing bearing assembled shafts with the wheels of the sliding apparatuses rolling on any one of a housing bore upper surface constituting the housing, spray frame upper surfaces, and the rails of the changing carriage within the housing, and extracting the divided backing bearing assembled shafts from within the housing and inserting the divided backing bearing assembled shafts into the housing by moving the divided backing bearing assembled shafts with the wheels of the sliding apparatuses rolling on the rails of the changing carriage outside the housing.

* * * * *